US007036600B2

(12) United States Patent
Johnson et al.

(10) Patent No.: US 7,036,600 B2
(45) Date of Patent: May 2, 2006

(54) TECHNIQUE FOR DEPLOYING EXPANDABLES

(75) Inventors: Craig D. Johnson, Letchworth (GB); Joel E. McClurkin, Houston, TX (US); Kian Rasa, Ithaca, NY (US); Peter A. Goode, London (GB); David L. Malone, Leatherhead (GB)

(73) Assignee: Schlumberger Technology Corporation, Sugarland, TX (US)

( * ) Notice: Subject to any disclaimer, the term of this patent is extended or adjusted under 35 U.S.C. 154(b) by 88 days.

(21) Appl. No.: 10/625,618

(22) Filed: Jul. 23, 2003

(65) Prior Publication Data

US 2004/0020660 A1 Feb. 5, 2004

Related U.S. Application Data

(60) Provisional application No. 60/400,161, filed on Aug. 1, 2002.

(51) Int. Cl.
*G21B 23/02* (2006.01)

(52) U.S. Cl. ..... 166/380; 166/55.8; 166/207

(58) Field of Classification Search ..... 166/380, 166/206, 207, 382, 387, 384, 55, 277, 216
See application file for complete search history.

(56) References Cited

U.S. PATENT DOCUMENTS

| | | | | |
|---|---|---|---|---|
| 1,945,079 | A | 1/1934 | Riemenschneider | |
| 1,981,525 | A | 11/1934 | Price | |
| 3,358,492 | A | 12/1967 | Richter | |
| 4,065,953 | A | 1/1978 | Frentzen et al. | |
| 4,309,891 | A | 1/1982 | Pogonowski | |
| 5,785,120 | A | 7/1998 | Smalley et al. | |
| 5,833,001 | A | 11/1998 | Song et al. | |
| 6,425,444 | B1 * | 7/2002 | Metcalfe et al. | 166/387 |
| 6,457,532 | B1 * | 10/2002 | Simpson | 166/380 |
| 6,478,091 | B1 | 11/2002 | Gano | |
| 6,478,092 | B1 | 11/2002 | Voll et al. | |
| 6,598,678 | B1 * | 7/2003 | Simpson et al. | 166/297 |
| 6,622,797 | B1 * | 9/2003 | Sivley, IV | 166/380 |
| 6,688,395 | B1 * | 2/2004 | Maguire et al. | 166/380 |
| 6,722,441 | B1 * | 4/2004 | Lauritzen et al. | 166/380 |
| 6,805,196 | B1 * | 10/2004 | Lawrence | 166/297 |
| 2001/0002626 | A1 | 6/2001 | Frank et al. | |
| 2001/0045284 | A1 | 11/2001 | Simpson et al. | |
| 2002/0046840 | A1 | 4/2002 | Schetky et al. | |

FOREIGN PATENT DOCUMENTS

GB 2371064 A 7/2002

(Continued)

OTHER PUBLICATIONS

Docket Sheet for *Memry Corporation* v. *Kentucky Oil Technology*, N.V., Case No. H-04-1959 (S.D. Tex.) (PACER Jun. 2, 2005) (5 pages).

(Continued)

*Primary Examiner*—Frank S. Tsay
(74) *Attorney, Agent, or Firm*—Van Someren, P.C.; Kevin P. McEnaney; Jaime A. Castano

(57) ABSTRACT

A technique for deploying expandables is provided. The technique comprises actuating an expansion tool such that the expansion tool imparts an outwardly directed radial force on an expandable tubular. More specifically, the expansion tool imparts radial expansion forces against an interior surface of the tubular thereby allowing the tubular to be deployed in a wellbore environment.

21 Claims, 20 Drawing Sheets

FOREIGN PATENT DOCUMENTS

| | | | |
|---|---|---|---|
| SU | 1745873 | A1 | 7/1992 |
| WO | WO 00/37766 | A2 | 6/2000 |
| WO | WO 00/37766 | A3 | 6/2000 |
| WO | WO 00/37767 | A2 | 6/2000 |
| WO | WO 00/37768 | A1 | 6/2000 |
| WO | WO 00/37773 | A1 | 6/2000 |
| WO | WO 02/38343 | A2 | 5/2002 |
| WO | WO 03/010414 | A1 | 2/2003 |
| WO | WO 03/078785 | A2 | 9/2003 |

OTHER PUBLICATIONS

Docket Sheet for *Memry Corporation* v. *Kentucky Oil Technology*, N.V., Case No. C-04-03843, (N.D. Cal.) (PACER Aug. 11, 2005) (13 pages).

Communication from United States District Court Transferring Case, *Memry Corporation* v. *Kentucky Oil Technology*, N.V., Case No. H-04-1959 (S.D. Tex.), dated Sep. 7, 2004 (1 page).

Plaintiffs' Original Complaint, *Memry Corporation* v. *Kentucky Oil Technology*, N.V., Case No. H-04-1959, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern District of California, *Memry Corporation* v. *Kentucky Oil Technology*, N.V., Case No. H-04-1959, (S.D. Tex.), filed Jul. 7, 2004 (49 pages).

Plaintiff's First Amended Complaint, *Memry Corporation* v. *Kentucky Oil Technology*, N.V., Case No. C-04-03843, (N. D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology*, N.V., Case No. C-04-03843, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Jan. 24, 2005 (32 pages).

[Proposed] Order Granting Schlumberger Technology Corporation's Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 24, 2005 (32 pages).

Request for Judicial Notice in Support of Schlumberger Technology Corporation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology*, N.V., Case No. C-04-03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology*, N.V., Case No. C-04-03843, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

[Proposed] Order Granting Memry Corporation's Motion to Dismiss Kentucky Oil Technology's Third Fourth, Fifth, and Sixth Counterclaims, *Memry Corporation* v. *Kentucky Oil Technology*, N.V., Case No. C-04-03843, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology*, N.V., Case No. C-04-03843, (N. D. Cal.), filed Mar. 11, 2005 (29 pages).

Kentucky Oil's Opposition to Counterdefendants' Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology*, N.V., Case No. C-04-03843, (N. D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology*, N.V., Case No. C-04-03843, (N.D. Cal.), filed Mar. 18, 2005 (9 pages).

Plaintiff and Counterdefendant Memry Corporation's Reply in Support of Request for Judicial Notice, *Memry Corporation* v. *Kentucky Oil Technology*, N.V., Case No. C-04-03843, (N.D. Cal.), filed Mar. 18, 2005 (4 pages).

Reply of Schlumberger Technology Corporation to Kentucky Oil Technology's Opposition to First Amended, Third, Fourth, Fifth, and Sixth Counterclaims, *Memry Corporation* v. *Kentucky Oil Technology*, N.V., Case No. C-04-03843, (N.D. Cal.), filed Mar. 18, 2005 (17 pages).

Schlumberger's Response to Kentucky Oil's Opposition to Counterdefendants' Requests for Judicial Notice, *Memry Corporation* v. *Kentucky Oil Technology*, N.V., Case No. C-04-03843, (N.D. Cal.), filed Mar. 18, 2005 (3 pages).

Schlumberger's Notice of Motion and Motion to Strike Exhibits 1, 2, and 4 to the Declaration of Nicola A. Pisano, *Memry Corporation* v. *Kentucky Oil Technology*, N.V., Case No. C-04-03843, (N.D. Cal.), filed Mar. 18, 2005 (3 pages).

Kentucky Oil's Opposition to STC's Motion to Strike Exhibits 1, 3 and 4 to the Declaration of Nicola A. Pisano, *Memry Corporation* v. *Kentucky Oil Technology*, N.V., Case No. C-04-03843, (N.D. Cal.), filed Mar. 25, 2005 (3 pages).

Kentucky Oil's Notice of Motion and Motion to Strike Declaration of Benjamin Holl and Portions of Counterdefendants' Reply Briefs, *Memry Corporation* v. *Kentucky Oil Technology*, N.V., Case No. C-04-03843, (N. D. Cal.), filed Mar. 25, 2005 (4 pages).
[Proposed] Order Granting Kentucky Oil's Motion to Strike Declaration of Benjamin Holl and Portions of Counterdefendants' Reply Briefs, *Memry Corporation* v. *Kentucky Oil Technology*, N.V., Case No. C-04-03843, (N. D. Cal.), entered Mar. 25, 2005 (2 pages).
Order Granting in Part and Denying in Part Counterdefendants' Motion to Dismiss, *Memry Corporation* v. *Kentucky Oil Technology*, N.V., Case No. C-04-03843, (N.D. Cal.), entered Apr. 8, 2005 (26 pages).
Plaintiff and Counterdefendant Memry Corporation's Reply to Kentucky Oil Technology N.V.'s Counterclaims and Demand for Jury Trial, *Memry Corporation* v. *Kentucky Oil Technology*, N.V., Case No. C-04-03843, (N.D. Cal.), filed Apr. 18, 2005 (8 pages).
Second Amended Counterclaims of Kentucky Oil Technology N.V. Against Memry Corporation and Schlumberger Technology Corporation, *Memry Corporation* v. *Kentucky Oil Technology*, N.V., Case No. C-04-03843, (N.D. Cal.), filed May 6, 2005 (20 pages).
Plaintiff Memry Corporation's Reply to Kentucky Oil Technology N.V.'s Second Amended Counterclaims and Demand for Jury Trial, *Memry Corporation* v. *Kentucky Oil Technology*, N.V., Case No. C-04-03843, (N.D. Cal.), filed Jun. 3, 2005 (9 pages).
Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun. 3, 2005 (18 pages).
Opposition of Kentucky Oil Technology to Schlumberger Technology Corporation's Motion to Dismiss Kentucky Oil's Second Amended Counterclaims, *Memry Corporation* v. *Kentucky Oil Technology*, N.V., Case No. C-04-03843, (N.D. Cal.), filed Jun. 17, 2005 (16 pages).
Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology*, N.V., Case No. C-04-03843, (N.D. Cal.), filed Jun., 24, 2005 (11 pages).
Order Granting in Part and Denying In Part STC's Motion to Dismiss, *Memry Corporation* v. *Kentucky Oil Technology*, N.V., Case No. C-04-03843, (N.D. Cal.), entered Jul. 14, 2005 (8 pages).
Schlumberger Technology Corporation's Answer to Kentucky Oil Technology's Second Amended Counterclaims, *Memry Corporation* v. *Kentucky Oil Technology*, N.V., Case No. C-04-03843, (N.D. Cal.), filed Jul., 28, 2005 (8 pages).
Notice o Motion and Motion by Kentucky Oil To Compel Production of Documents by Schlumberger Technology Corporation Pursuant to Fed. R. Civ. Rule 37; Memorandum of Points and Authorities in Support Thereof; Declaration of Michael Bierman, *Memry Corporation* v. *Kentucky Oil Technology*, N.V., Case No. C-04-03843, (N.D. Cal.), filed Jul. 28, 1005 (32 pages).
Schlumberger Technology Corporation's Opposition to Kentucky Oil Technology's Motion to Compel, *Memry Corporation* v. *Kentucky Oil Technology*, N.V., Case No. C-04-03843, (N.D. Cal.), filed Aug. 4, 2005 (21 pages).
Declaration of David B. Moyer in Support of Schlumberger Technology Corporation's Opposition to Kentucky Oil Technology's Motion to Compel, *Memry Corporation* v. *Kentucky Oil Technology*, N.V., Case No. C-04-03843, (N. D. Cal.), filed Aug. 4, 2005 (52 pages).
Declaration of Nicola A. Pisano in Support of Kentucky Oil's Motion to Compel, *Memry Corporation* v. *Kentucky Oil Technology*, N.V., Case No. C-04-03843, (N.D. Cal.), filed Aug. 10, 2005 (69 pages).
Order Granting Kentucky Oil's Motion to Compel Production of Documents, *Memry Corporation* v. *Kentucky Oil Technology*, N.V., Case No. C-04-03843, (N.D. Cal.), entered Aug. 17, 2005 (8 pages).

* cited by examiner

TECHNIQUE FOR DEPLOYING EXPANDABLES

CROSS REFERENCE TO RELATED APPLICATIONS

The following is based on and claims the priority of provisional application No. 60/400,161 filed Aug. 1, 2002.

BACKGROUND OF THE INVENTION

A variety of expandable tubulars have been used in wellbore environments. For example, expandable liners and expandable sand screens have been deployed downhole. The expandability permits deployment of the expandable while in a reduced diameter followed by subsequent radial expansion of the device once at a desired location. Typically, the expandable tubular comprises a plurality of slots or other types of openings that are increased in size as the tubular is expanded. The openings generally permit flow of fluid into the interior of the expandable from the surrounding formation.

Expansion of the tubular device generally is achieved by moving a tapered mandrel in an axial direction through the center of the tubular. For example, the expandable device may be deployed with a tapered mandrel position at a lower or lead end of the tubular. Upon reaching the desired deployment location, the tapered mandrel is pulled through the center of the tubular via a wire line, tubing, or other mechanism. The mandrel tapers radially outwardly to a diameter larger than the initial diameter of the tubular. Thus, movement of the tapered mandrel through the tubular forces a radial expansion of the tubular to a larger diameter. Alternatively, the tapered mandrel is pushed through the expandable tubular from a top or trailing end to similarly force expansion of the tubular device.

SUMMARY OF THE INVENTION

The present invention relates to a technique for expanding a variety of tubulars. For example, tubulars, such as sand screens or liners, are appropriately positioned within a wellbore and subsequently expanded. The expansion technique comprises a variety of expansion tools, each tool having the ability to impart the forces necessary to expand tubulars from a collapsed state to an expanded state.

BRIEF DESCRIPTION OF THE DRAWINGS

The foregoing and other advantages and features of the invention will become apparent upon reading the following detailed description and upon reference to the drawing in which.

DETAILED DESCRIPTION

Figure 1:
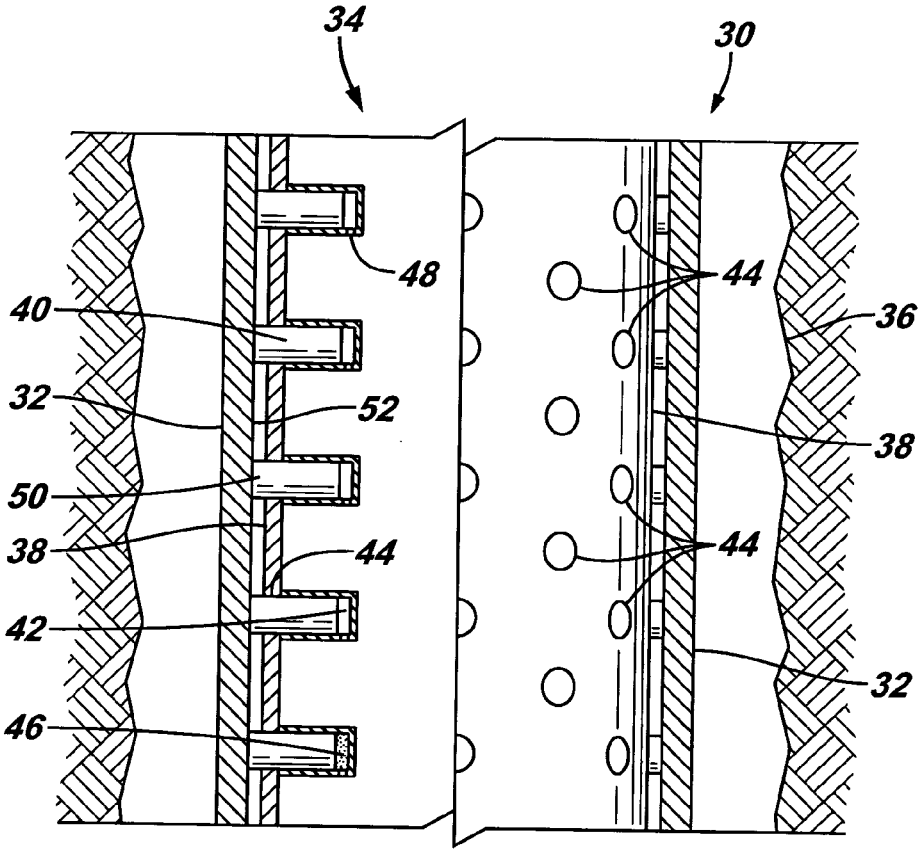
FIG. 1 is a partial cross-sectional view of an embodiment of the present in invention illustrating an embodiment of an expansion tool disposed within a wellbore.

Referring generally to FIG. 1, an embodiment of an expandable tubular assembly 30 is illustrated in a contracted configuration. The expandable assembly 30 comprises an expandable tubular 32 disposed circumferentially about a deployment tool 34. The illustration presents a partial cross-sectional view of the assembly 30 as disposed within a wellbore 36. Accordingly, only a representative portion of the assembly 30 is shown. Within the wellbore 36, however, the actual assembly may extend for a substantial length, e.g. over 100 meters.

When in the collapsed configuration, insertion of the assembly 30 into the wellbore 36 is facilitated by the diameter of the assembly 30 being less than the diameter of the wellbore 36. Accordingly, proper positioning of the assembly 30 within the wellbore 36 does not require the application of a substantial axial insertion force. As such, the time and labor necessary to introduce the tubular 32 into the wellbore is substantially reduced and cost savings may be realized. Moreover, the likelihood of damage to the tubular 32 during insertion is also greatly reduced again leading to the realization of improved efficiency and cost savings.

Once the assembly 30 is positioned at the desired location within the wellbore 36, the deployment tool 34 may be actuated to impart outwardly directed radial forces on the expandable tubular 32. In response to the radial forces, the expandable tubular 32 is expanded toward the wall defining wellbore 36.

One example of the deployment tool 34 used in this arrangement is a piston-type tool that comprises a pipe 38 disposed circumferentially about pistons 40 and corresponding piston chambers 42. Located at a plurality of locations throughout the pipe 38 may be apertures 44 through which the pistons 40 may be directed during actuation of the tool 34. The relationship between the pistons 40 and the apertures 44 are discussed more fully below.

To facilitate actuation of tool 34, a hydraulic fluid 46 may be directed through an annular flow path 48 disposed between the chambers 42 and pistons 40. As the hydraulic fluid 46 enters the respective chambers 42, the build up of hydrostatic pressures drive the corresponding pistons 40 radially outward through the corresponding apertures 44. As a result, piston heads 50 abut against an inner surface 52 of the expandable tubular 32. As the piston heads 50 continue to travel radially outward, the piston heads 50 expand tubular 32 radially outward as well, thereby transitioning the expandable tubular 32 from a collapsed to an expanded configuration. In this expanded configuration, the tubular 32 may rest against the interior surface of the wellbore 36.

Once expanded, the hydrostatic pressures may be relieved by releasing the hydraulic fluid. In turn, the biasing forces on pistons 40 are removed, and the expansion tool 34 returns to its collapsed configuration. However, the deployed tubular 32 remains in the expanded configuration. In the collapsed configuration, the tool 34 may be retrieved to the surface, or, if so desired, redeployed to an unexpanded portion of tubular.

Figure 2:
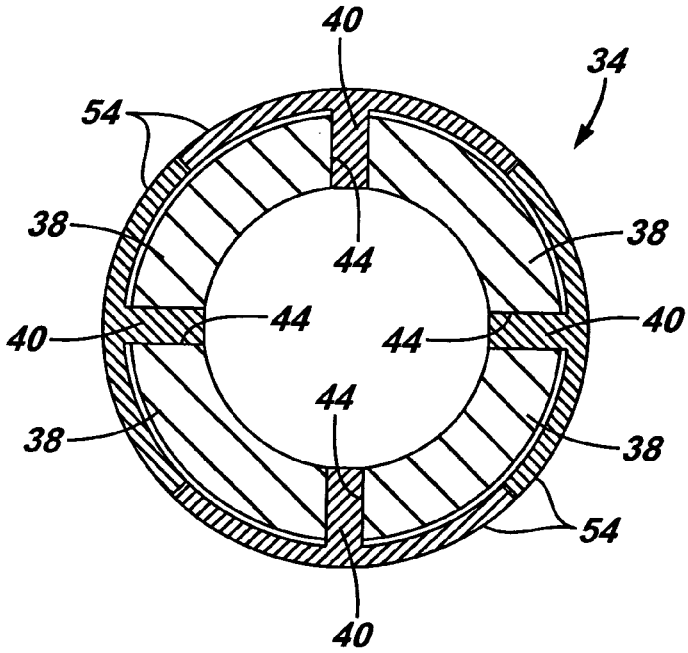
FIG. 2 is a cross-sectional view of an embodiment of an expansion tool comprising pistons.

Referring generally to FIG. 2, an embodiment of a piston-type deployment tool 34 is illustrated as similar to the tool illustrated in FIG. 1. However, this tool 34 comprises hammer-head expansion plates 54 coupled to respective pistons 40. In this arrangement, the expansion plates 54 are disposed circumferentially about the pipe 38 and are coupled to the pistons 40 through apertures 44 disposed at various locations along pipe 38. The expansion plates 54, when in the closed configuration, present a continuous surface. However, various other plate 54 configurations are envisaged. For example, the expansion plates 54 may be configured to best suit the particular specifications of a given wellbore or expandable tubular.

Similar to the foregoing arrangement, the pistons 40 of this arrangement are actuated in a radially outward direction by, for example, internal hydrostatic pressure. Accordingly the expansion plates 54 are driven in a radially outward direction as well. Expansion plates 54 provide a large engagement surface area (i.e., profile) with respect to the tubular 32 which, in turn, provides a more even force distribution against expandable tubular 32. Thus, the expandable tubular 32 may present a more uniform expanded diameter upon expansion.

After expansion of tubular 32, the hydrostatic pressure may be relieved to return the tool 34 to a collapsed configuration. (It is worth noting that for the purposes of explanation, this arrangement may be actuated hydraulically, however, as will be discussed below, other methods of actuation are envisaged.) In this collapsed configuration, the deployment tool 34 may easily be retrieved from or repositioned in the wellbore 36.

Figure 3:
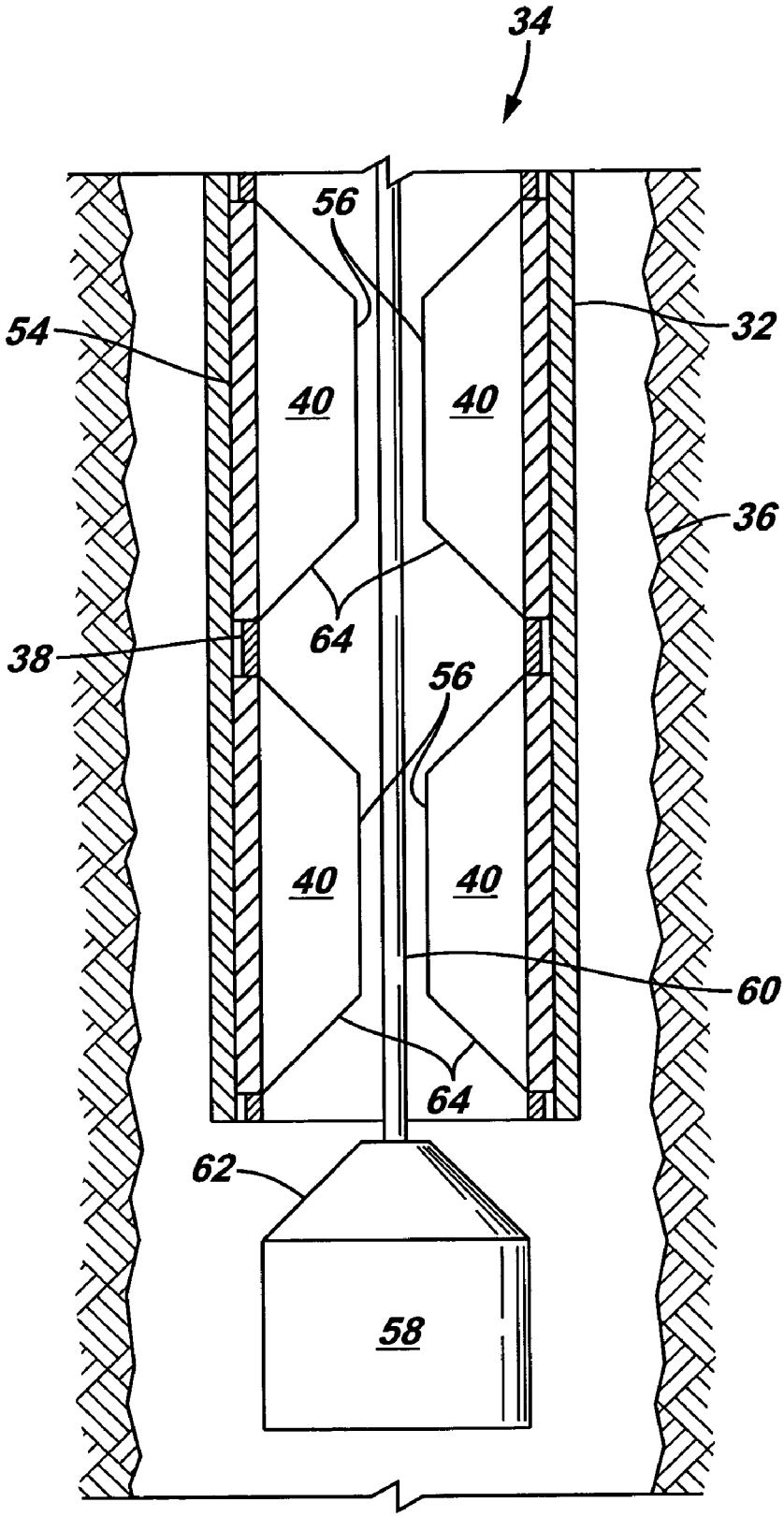
FIG. 3 is a cross-sectional view of an embodiment of an interference-type expansion tool disposed in a wellbore.
Figure 4:
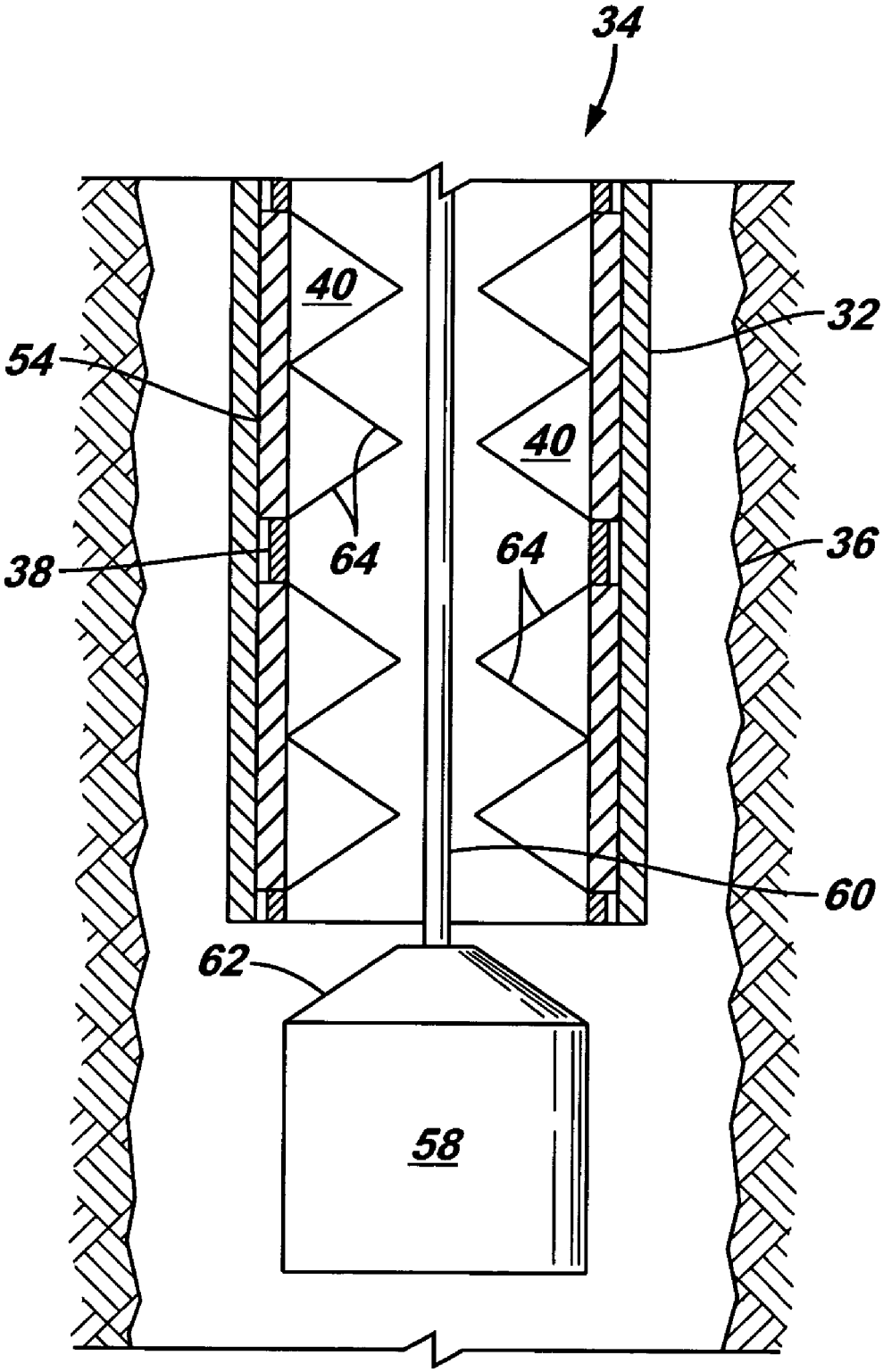
FIG. 4 is a cross-sectional view of an expansion tool similar to the tool of FIG. 3 but further illustrating a variation in configuration of the interference region.

As illustrated in FIGS. 3 and 4, an alternate arrangement of the piston-type deployment tool 34 may be a mechanically actuated device. In this arrangement, the pistons 40 may be actuated by an interference that occurs between piston bases 56 and the external surface of a rabbit 58. In operation, the rabbit 58 may be either pushed into engagement with the piston bases 56 or pulled by, for example, a wireline 60. The interference between the two structures, in turn, drives the pistons 40 and respective expansion plates 54 coupled thereto in a radially outward direction. Resultantly, the actuation of the plates 54 biases the expandable tubular 32 to its expanded configuration.

In the specific embodiment illustrated, the wireline 60 pulls the rabbit 58 from a downhole location toward the surface. As the rabbit 58 progresses upwardly, a sloped surface 62 disposed on the leading end of the rabbit 58 engages correspondingly configured sloped piston surfaces 64. The respective sloped surfaces 62 and 64 present a gradual engagement region that facilities translation of the vertical displacement of the rabbit 58 into a lateral displacement of the piston 40. In the embodiment illustrated in FIG. 4, sloped surfaces 62 and 64 are inclined at a greater angle with respect to vertical. Accordingly, the translation of force and corresponding displacement (from vertical to horizontal) occurs at an expedited rate. Moreover, the height of the expansion plates 54 may be shortened, if so desired, to enable greater variances in the expansion diameter of the expandable tubular 32 when driven by the pistons 40. Furthermore, the interference between rabbit 58 and piston 40 enables the deployment tool 34 to conform the expandable tubular 32 to imperfections and variations, such as varying open-hole diameters, found throughout the inner surface of the wellbore.

Figure 5:
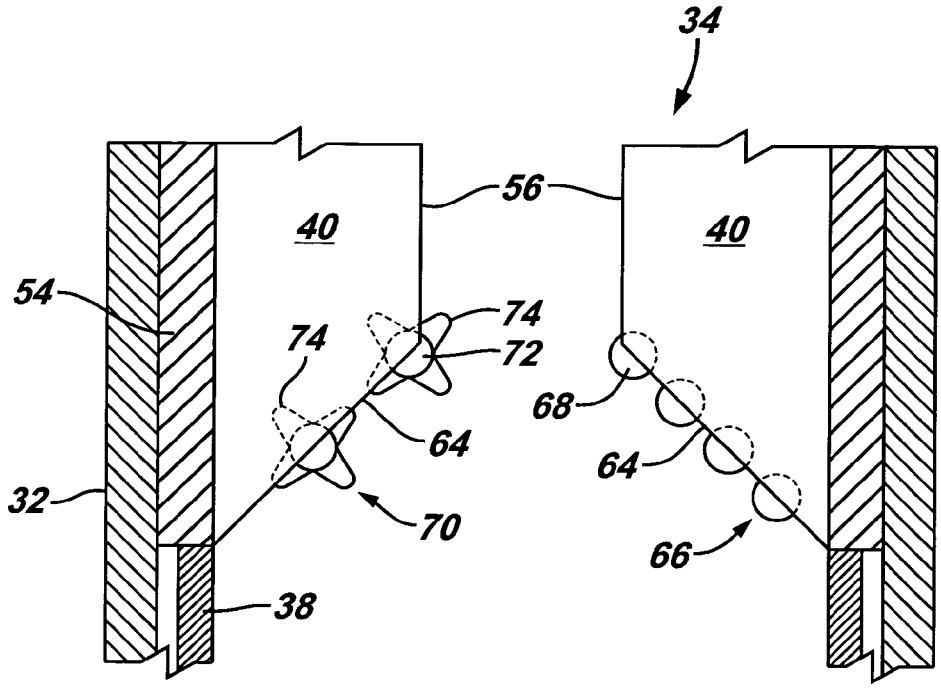
FIG. 5 is a cross-sectional view of an interference region of a piston system comprising various sub-mechanical assemblies, according to another embodiment of the present invention.

Focusing on the pistons 40, various mechanical features may be provided on the sloped piston surfaces 64. Referring to FIG. 5, two examples of sub-mechanical assemblies are illustrated. The first assembly 66 comprises circular rollers 68 and the second assembly 70 comprises extension rollers 72, wherein each of the extension rollers 72 may include finger-like projections 74. In operation, the rollers 68 and 72 function, in a similar fashion, to increase the available mechanical expansion forces. Rollers 68 and 72 reduce the resistive frictional force induced between the rabbit 58 and the corresponding pistons 40, thus reducing energy lost as frictional heat between the two structures. By employing rollers, more of the vertical force component otherwise necessary to move rabbit 58 may be translated into a horizontal force component against the pistons 40 and subsequently imparted to the coupled expansion members 54.

Figure 6:
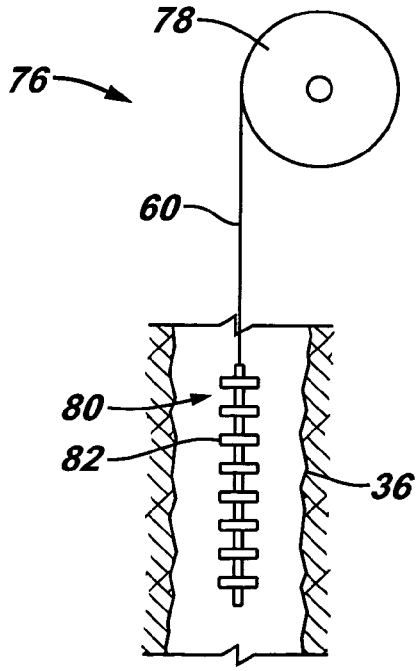
FIG. 6 is a depiction of an embodiment of a drive mechanism for insertion and retraction of an expansion tool.

As noted above, the rabbit 58 may either be pushed downhole from the surface or pulled up from a downhole location. In pushing the rabbit 58, a downward force applied to the rabbit 58 biases the rabbit 58 to a downhole position. As the rabbit 58 travels downhole, the rabbit 58 engages pistons 40 and induces expansion of the tubular 32. In pulling the rabbit 58, the rabbit 58 may be placed at a downhole position in the wellbore 36 prior to insertion of the deployment tool 34. To facilitate the subsequent pulling of the rabbit 54, (i.e., after the deployment device and tubular are deployed within the wellbore) the wire-line 60 (FIGS. 3 and 4) may be fed into the wellbore 36. Feeding of the wire-line 60 may be conducted via a flanged rabbit connect system 76 as depicted in FIG. 6.

The connect system 76 comprises a wireline unit 78 which provides a feed source for the wireline 60. The wireline 60 may be biased in the downhole direction via hydrostatic pressure placed upon a series of flanged rabbit connects 80. In other words, the rabbit connect 80 may be pumped downhole to connect with the rabbit 58 (see FIGS. 3 and 4). During downward insertion of the rabbit connect 80, flanges 82, in conjunction with the pistons 40 (see FIG. 3), form seals that help move the rabbit connect 80 downhole and into engagement with the rabbit 58. Once engaged, the rabbit 48 may be winched, via the wireline 60, up through the wellbore 36 thereby actuating the deployment tool 34.

Figure 7:
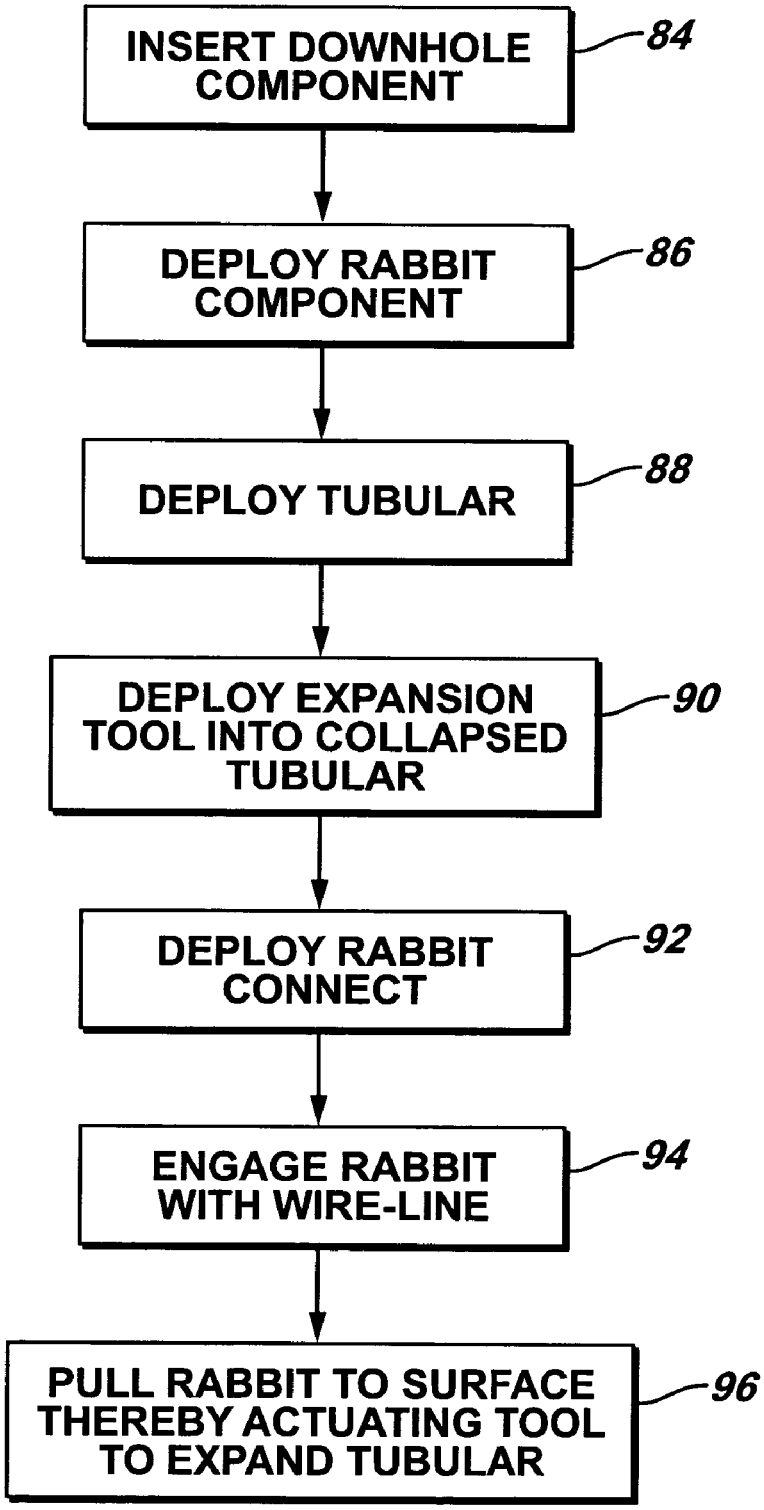
FIG. 7 is a flow chart representing an example of the installation and operation of an expansion system.

FIG. 7 represents one example of a sequence for the installation and operation of an interference-type expansion tool in flow chart form. In this sequence, a downhole component such as an expandable screen shoe is inserted into the wellbore (see block 84). Subsequently, the rabbit 58 is deployed into the wellbore 36 (see block 86). Then, tubular 32 is deployed to the desired location followed by installation, if desired, of a packer (see block 88). The deployment tool 34 may then be installed into the wellbore (see block 90). Once the deployment tool 34 is properly positioned at a desired location, the rabbit connect system 70 is hydraulically fed into the wellbore 36 (see block 92). Upon reaching the rabbit 58, connect system 70 is engaged by coupling the rabbit 58 to the wireline 60 (see block 94). Once the connection is complete and verified (i.e. weight on the wireline 60) the rabbit 58 is pulled to the surface (see block 96). The vertical displacement of the rabbit 58, as discussed above, radially biases the expansion plates 54 and expands the tubular 32. During expansion of the tubular 32, live caliper readings and feedback may be recorded to help determine if successful expansion has occurred. Moreover, these measurements may provide a logging of the well. Advantageously, this sequence permits, if so desired, circulation.

Figure 8A:
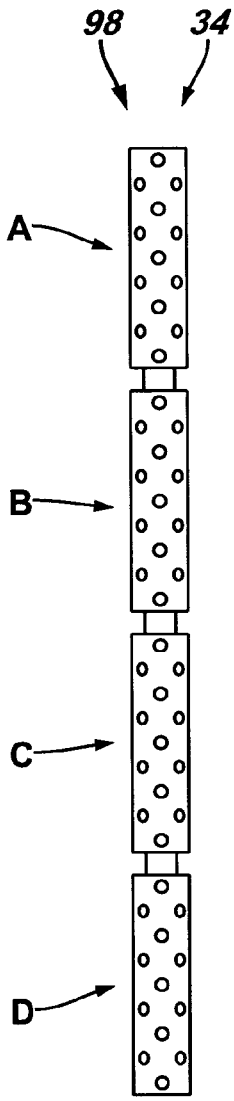
FIGS. 8A–8C are representations of expansion stages of an embodiment of an expansion system comprising a plurality of pistons.
Figure 8B:
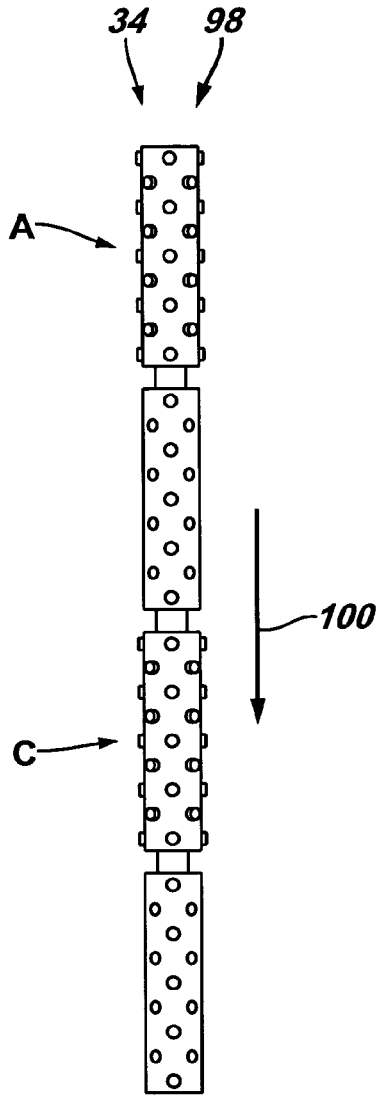
Figure 8C:
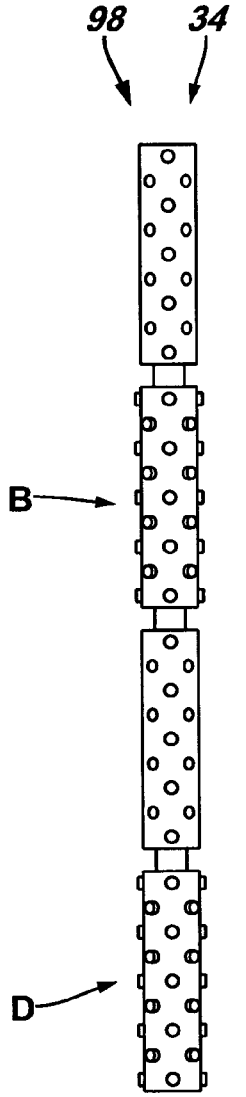

Turning to FIGS. 8A–8C, another deployment sequence is depicted. In this embodiment, a self-indexing system 98 propagates in a downhole direction 100, roughly similar to a caterpillar-like motion. For the purposes of explanation, the subject system may employ the hydraulically actuated piston arrangement as illustrated in FIG. 1. However, the system may comprise other arrangements and embodiments as well. Basically, the system 98 expands the tubular 32 at a first location and subsequently self-indexes itself to the next location for expansion.

By way of example, system 98 comprises four expansion sections labeled A, B, C and D respectively (see FIG. 8A). Each section represents a section of the deployment tool (as illustrated in FIG. 1). In the first phase, illustrated as FIG. 8B, the pistons of expansion sections A and C engage the inner diameter of the expandable tubular. Also, during this phase, the pistons of sections B and C are disengaged and the sufficiently collapsed to slide down to their next location in the tubular. As this phase is completed, phase 2, illustrated in FIG. 8C, begins with the simultaneous retraction of pistons of sections A and C and the expansion/engagement of pistons of sections B and D. Thus, alternating engagement and disengagement of the respective section causes the deployment tool to move downhole in a manner, as stated above, roughly similar to that of a caterpillar.

The alternating between phases may be controlled by the rotation of a sleeve comprising a j-slot type pattern in conjunction with the maintenance of hydraulic pressure within the tool. As the sleeve rotates, radial displacement of the pistons 40 is restricted by abutment against the sleeve. However as the slotted portion of the sleeve passes over the corresponding pressurized piston, the piston expands through the slot. Upon further rotation, the sleeve may then bias the piston back into its corresponding chamber.

Figure 9A:
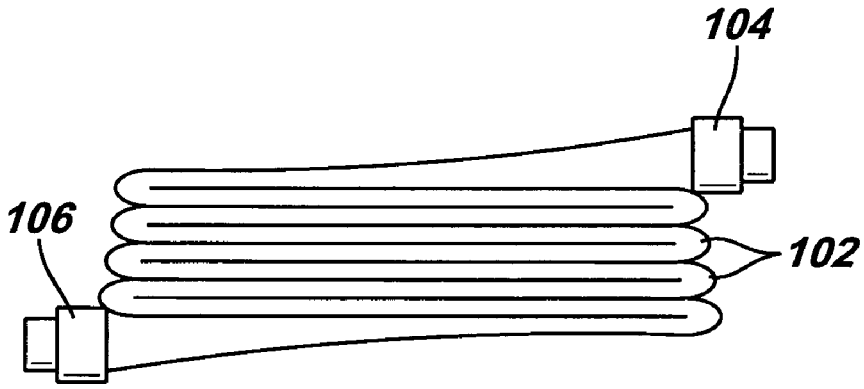
FIGS. 9A–9D illustrate embodiments of an expansion tool comprising an inflatable hose or hoses.
Figure 9B:
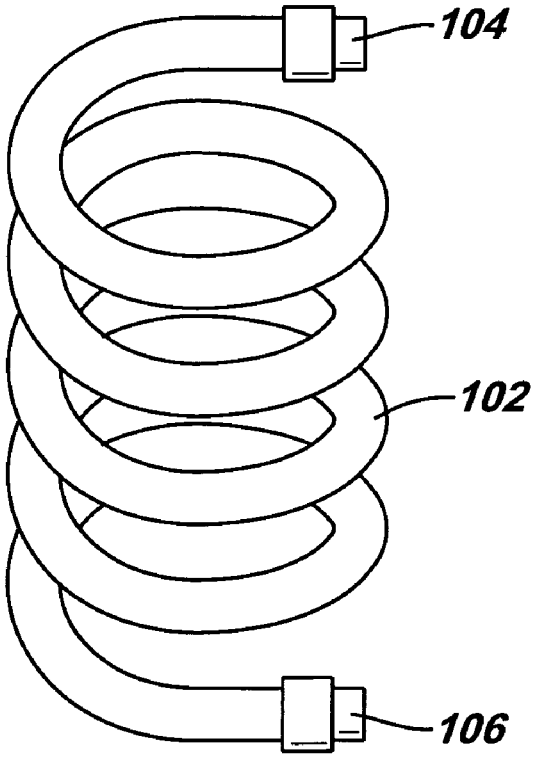

Another embodiment for expanding tubulars comprises an inflatable member that may be inflated to provide the radial forces necessary for tubular expansion. In this embodiment, a fluid may be pumped into the inflatable member thereby expanding the member and the tubular. For example, FIGS. 9A and 9B illustrate an expandable hose arrangement of the present embodiment. In this arrangement, a flexible hose 102, similar to that of a high-pressure firefighting hose, may be placed along the inside diameter of the expandable tubular (not shown in this figure) prior to insertion of the tubular within the wellbore. As can be seen from FIG. 9A, the flexible hose 102, in its collapsed configuration, presents a relatively flat profile as well as a relatively small volume. Accordingly, the flexible hose 102, in the collapsed state, may easily be straightened and placed along the internal diameter of the tubular.

To expand the flexible hose 102 and, in turn, the tubular, a fluid is pumped into the hose via a hose inlet 104. A closed end or closed outlet 106 may be disposed on the distal end of the hose 102 to contain the fluid build-up in the hose. As the fluid build-up progresses, hose 102 expands as illustrated in FIG. 9B. In many applications, the hose may be arranged linearly through the tubular. By expanding the volume of the hose 102 beyond the volume available within the collapsed tubular, the radial forces necessary to expand the tubular are produced. Once the tubular has been expanded to its desired state, the hose outlet 106 may be opened thereby releasing the fluid under its own pressure. The loss of fluid, in turn, causes the hose 102 to return to its collapsed configuration at which time the hose 102 may be easily withdrawn from the wellbore.

Figure 9C:
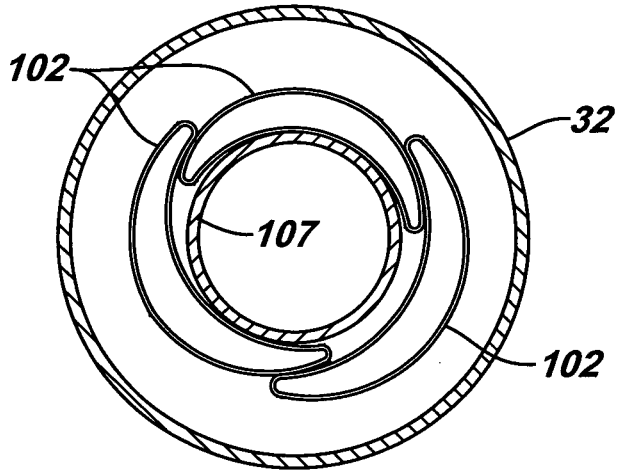
Figure 9D:
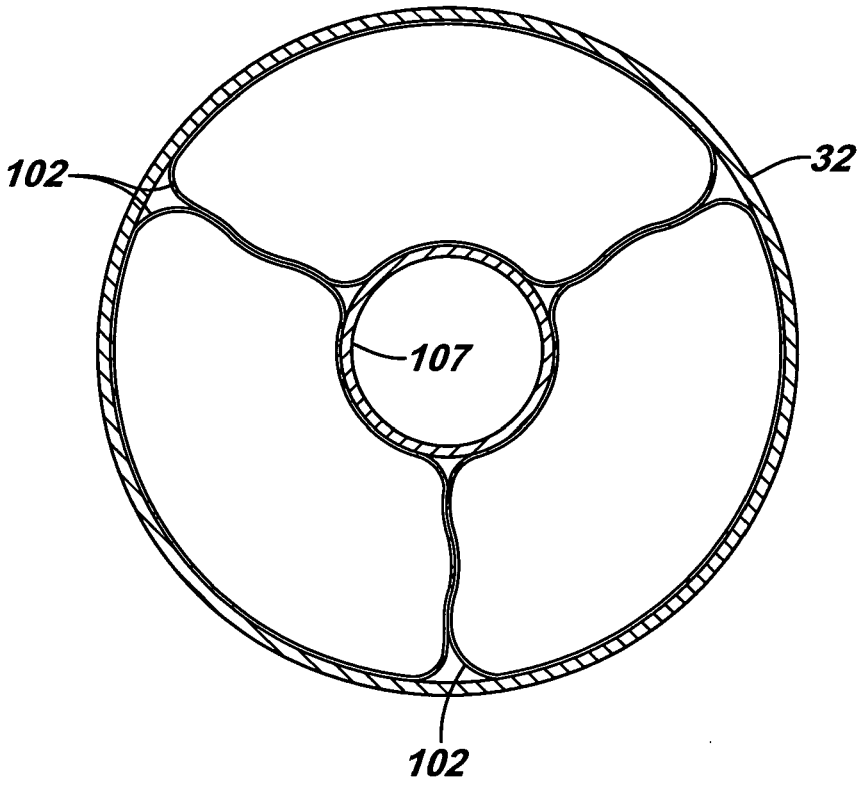

In an alternate embodiment illustrated in FIGS. 9C and 9D, a plurality of hoses 102 is used to expand a tubular 32. In one example, the plurality of hoses 102 is assembled about a central tube or mandrel 107. The multiple hoses 102 are filled with fluid to transition tubular 32 from the contracted state, as illustrated in FIG. 9C, to an expanded state, as illustrated in FIG. 9D. In the embodiment illustrated, three hoses 102 are mounted about tube 107 although other numbers of hoses can be used. Additionally, hoses 102 are illustrated as extending generally linearly through tubular 32, but the hoses can be wrapped around tube 107 or placed in other orientations within tubular 32.

For deploying these embodiments in horizontal or directional wellbores, it may be advantageous to insert the flexible hose or hoses 102 into the tubular after the tubular has been deployed to a kickoff point such that the tubular is still vertical. Once the flexible hose 102 has been inserted, the entire tubular may then be run to the desired depth.

Figure 10A:
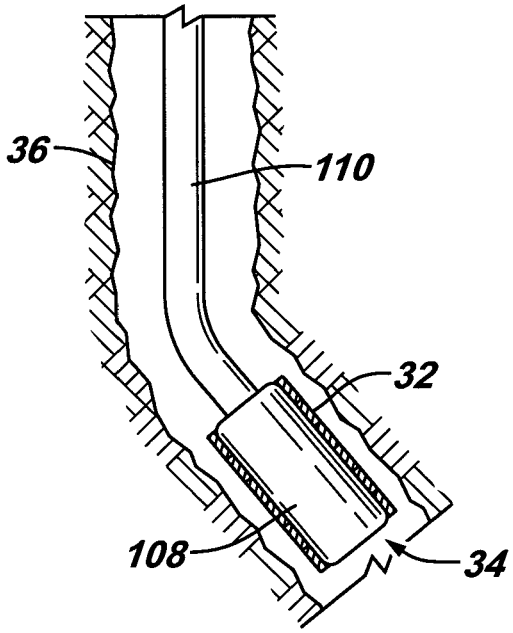
FIGS. 10A–10C depict an embodiment of a deployment tool comprising a bladder.
Figure 10B:
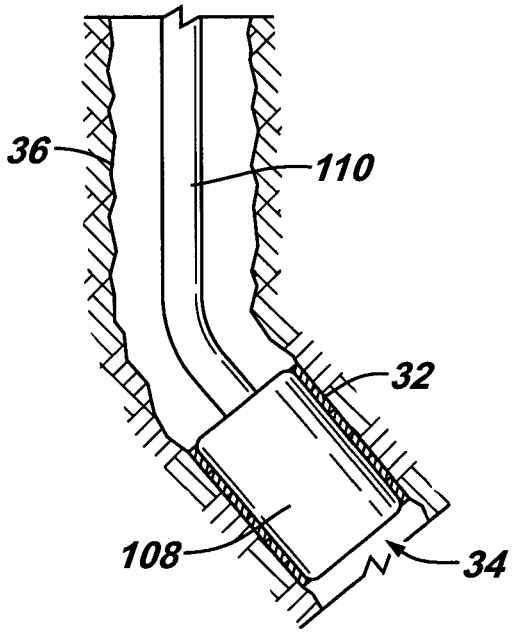
Figure 10C:
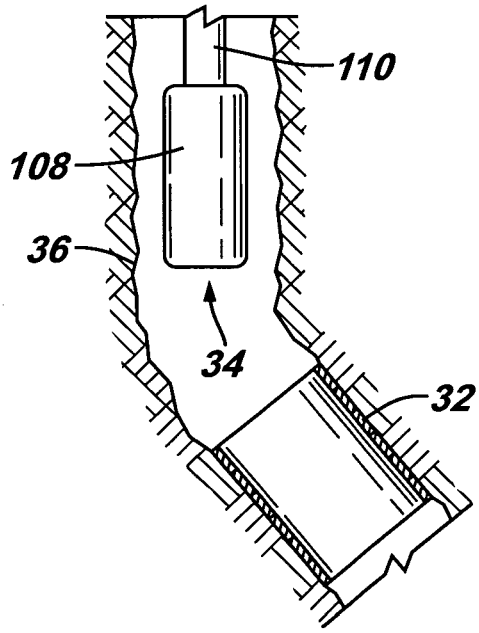

Although this embodiment has been demonstrated with respect to a flexible hose, other arrangements are envisaged. For example, FIGS. 10A–10C illustrate the various stages of deployment of an alternate arrangement of the present embodiment. In this arrangement, the deployment tool 34 comprises a bladder 108 coupled to a fluid source tube 110. Beginning with FIG. 10A, this figure illustrates the deployment tool 34 in its collapsed configuration. In this configuration, the deployment tool 34, along with an expandable tubular 32 disposed therearound, are fed into a wellbore 36. Once the desired deployment location is reached, as illustrated in FIG. 10B, a fluid fed in from the tubing 110, provides sufficient hydrostatic pressures to expand the bladder 108 and the tubular 32. Once the tubular 32 is deployed, the fluid may be drained from the bladder 108 thereby returning the bladder 108 to its collapsed configuration. Subsequently, as illustrated in FIG. 10C, the deployment tool 34 may be withdrawn from the wellbore 36 while the tubular 32 remains at its deployed position.

Figure 11A:
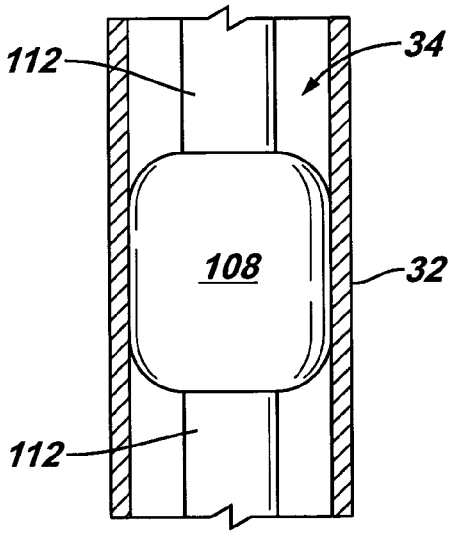
FIGS. 11A and 11B illustrate an embodiment of an expansion tool disposed within a tubular, the tool comprising a volume of alterable shape.
Figure 11B:
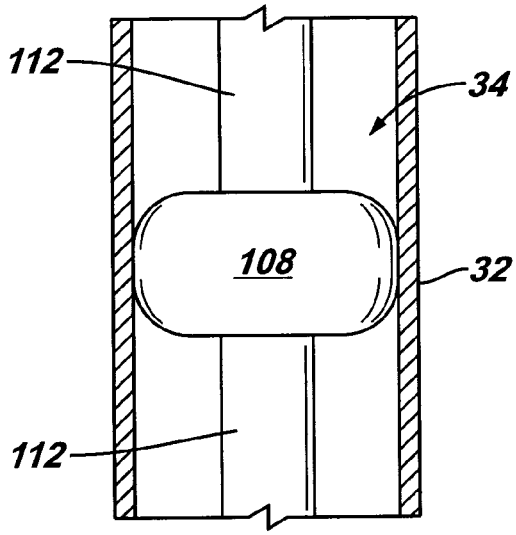

In another arrangement of the present embodiment, as illustrated in FIGS. 11A and 11B, the fluid may be pre-filled into a bladder 108 and subsequently compressed, thereby expanding the bladder 108 in a radial direction and, in turn, expanding the tubular 32. In this arrangement, compression members 112 are axially positioned on opposite sides of the bladder 108. In the collapsed configuration, as illustrated in FIG. 11A, the bladder 108 conforms to the smaller inner diameter of the collapsed tubular 32. However, once the compression members 112 are actuated in the axial direction, as illustrated in FIG. 11B, the axial dimension of the bladder 108 is reduced and, because the volume of the bladder 108 remains constant, the radial dimension of the bladder 108 increases. As the radial dimension of the bladder 108 increases, the bladder imparts radial forces on the tubular 32 thereby driving the tubular 32 to its expanded configuration. After deployment, the axial compression members 112 may be retracted and the elasticity of the bladder 108 may return the bladder 108 to its original spherical configuration. In another embodiment of the present technique, a compressed member may be placed within the wellbore and subsequently allowed to expand to its ambient state, the expansion of the member providing the radial forces necessary to expand the tubular.

Figure 12A:
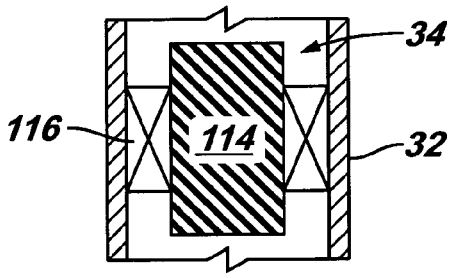
FIGS. 12A and 12B illustrate an embodiment of an expansion tool disposed in a tubular, the tool comprising a compressed elastomer.
Figure 12B:
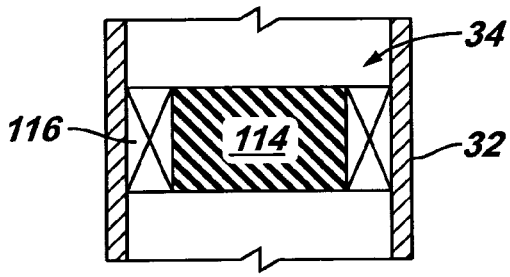

Referring to FIGS. 12A and 12B, another embodiment is illustrated. The deployment tool 34 comprises an elastomeric member 114 circumscribed by an expandable packer 116. In the collapsed configuration, as illustrated in FIG. 12A, a restrictive radial force on the elastomeric member 114 may be imparted by the packer 116 such that the elastomeric member 114 remains in its compressed configuration. While in this compressed configuration, the deployment tool 34 may easily be placed at the desire location within the expandable tubular 32. Once the desired deployment location is reached, however, the radially restrictive force may be removed, allowing expansion of the packer 116 and the elastomer 114 to their respective ambient expanded configurations. As a result of the expansion, outwardly directed radial forces produced by the abutment of the expanding deployment tool 34 against the inner diameter of the tubular 32 cause the tubular 32 to achieve its expanded configuration, as illustrated in FIG. 12B.

Figure 13A:
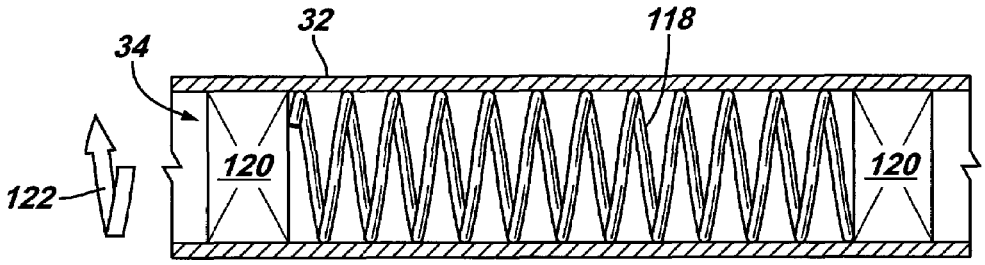
FIGS. 13A and 13B illustrate an embodiment of an expansion tool comprising a spring.
Figure 13B:
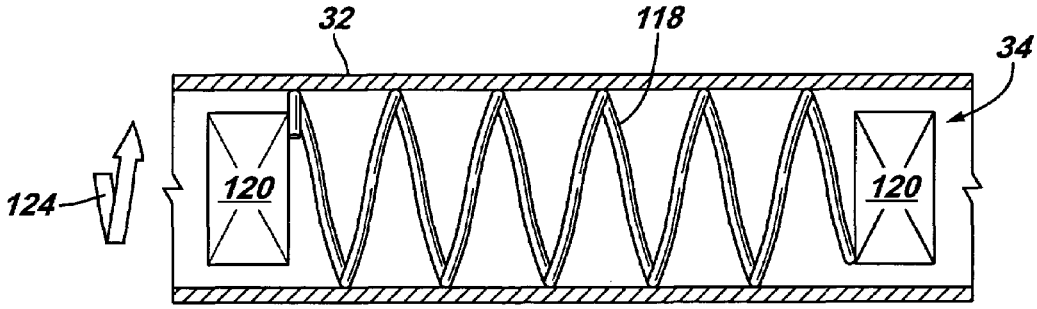

FIGS. 13A and 13B illustrate an alternative arrangement of the present embodiment deployed, for example, in a horizontal wellbore. In this arrangement, the deployment tool 34 comprises a spring member 118 disposed between axially aligned restraint members 120. Prior to deployment, the spring may be loaded by fixing one end of the spring 118 in place while simultaneously rotating the opposite end in a direction 122 consistent with the cut of the spring 118. By rotating the spring 118 in this manner, the axial length of the spring 118 increases while simultaneously decreasing the outer diameter of the spring 118. After the spring 118 has been loaded, it may be placed at the desired location within the wellbore and subsequently allowed to expand to its ambient state. When released, the spring 118 rotates in a direction 124 against the cut of the spring 118 causing the axial length of the spring 118 to reduce while simultaneously expanding the outer diameter of the spring 118. The expanding spring 118, in turn, abuts against the inner diameter of the tubular 32 and resultantly imparts radial expansion forces on the tubular 32, thereby biasing the tubular 32 to its expanded configuration.

Alternatively, expansion of the tubular 32, via the present arrangement, may also be achieved by rotating the spring 118 in the direction 124 against the cut of the spring 118, or in other words, in a direction opposite the direction 122 described immediately above. By rotating the spring against the direction 124 of the cut, the spring 118 begins to unwind. Accordingly, the length of the spring 118 decreases while the outside diameter of the spring 118 concurrently increases. The increasing diameter causes the spring 118 to abut against the inner diameter of the tubular 32, and, as such, imparts an outwardly directed radial force on the tubular 32. In turn, the tubular 32 is biased to its expanded configuration. After expanding the tubular 32, release of at least one of the restraining members 120 causes the spring to naturally rotate counter to the direction 124 and returns the spring to its ambient configuration, e.g., its natural length and diameter. Once in its ambient state, the deployment tool 34 may simply be repositioned at the next expansion position within the tubular 32 and the foregoing process repeated.

Figure 14:
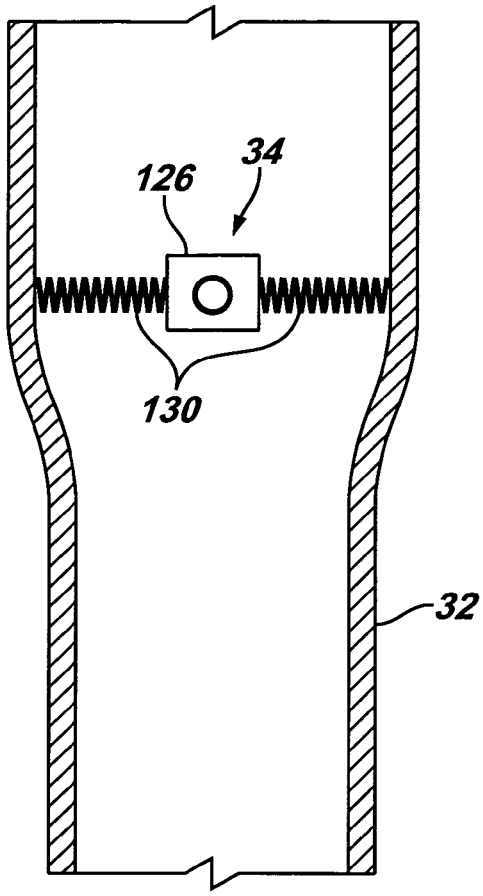
FIG. 14 illustrates an embodiment of an expansion tool disposed in a tubular, the expansion tool comprising a plurality of compression springs disposed radially about a central hub.

In an alternative arrangement of the present embodiment, as illustrated in FIG. 14, expansion of the tubular 32 may be facilitated by the use of a plurality of compression springs 130 disposed, at a variety of angles, radially around the external surface of a central hub 126. Accordingly, as the deployment tool 34 is driven in a downward direction within the tubular 32, the radial forces imparted by the compression springs 130 expand the tubular 32. If so desired, expansion plates (not shown) may be placed on the abutment end of the compression members 130 thereby providing better force distribution during expansion of the tubular 32.

Figure 15:
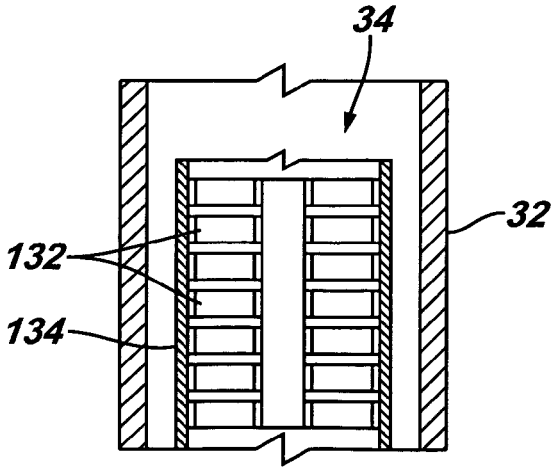
FIG. 15 illustrates an embodiment of an expansion tool disposed in a tubular and comprising a plurality of expansion discs.
Figure 16A:
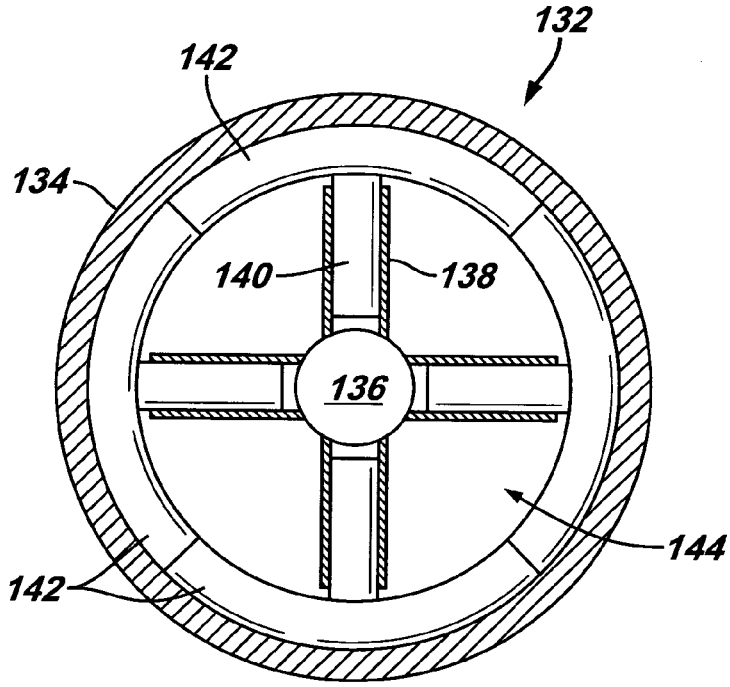
FIGS. 16A and 16B are cross-sectional views of the expansion tool illustrated in FIG. 15.
Figure 16B:
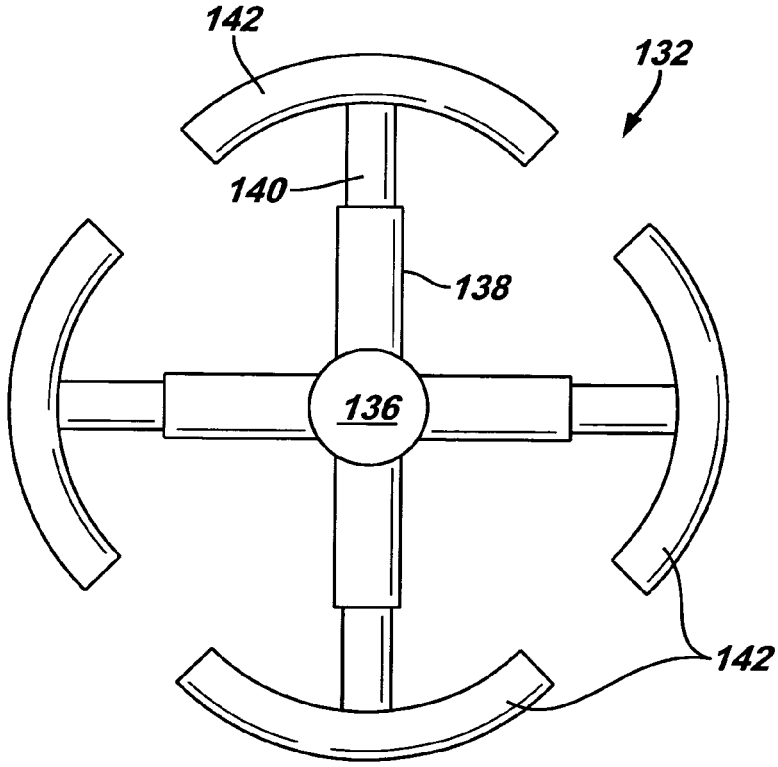

In another embodiment of the present technique, expansion of tubulars may be facilitated by the expansion of spring-loaded discs against the inner diameter of the tubular. For example, FIGS. 15, 16A and 16B illustrate various views of an exemplary arrangement with respect to this embodiment. In this arrangement, the deployment tool 34 comprises a plurality of spring-loaded discs 132 which are constrained from expanding in the radial direction by a sleeve 134 or other restraint mechanism disposed circumferentially about the discs 132. As the deployment tool 34 reaches the desired deployment location within the tubular 32, the sleeve 134 is removed and the discs 132 are permitted to expand, in turn, imparting radial forces sufficient to expand the tubular 32.

Referring more specifically to FIGS. 16A and 16B, a cross-sectional view of one embodiment of disc 132 is shown, the disc 132 being in the contracted and expanded configurations, respectively. Each respective disc 132 in this arrangement comprises a center tube 136 surrounded by four spring-loaded piston chambers 138. The spring-loaded piston chambers 138 may be configured to receive corresponding piston members 140, and coupled to the respective piston members 140, to improve the radial force distribution, may be expansion heads 142. Within the interior of the disc 132, may be empty gaps 144 that provide for modification space as well as access openings to components of the disc 132 while the disc 132 is disposed within the wellbore.

When in the collapsed configuration, as depicted in FIG. 16A, the sleeve 134 maintains the disc 132, specifically the expansion heads 142, in the compressed configuration. Moreover, when in the compressed configuration, the expansion heads 142 may be configured such that they form a continuous circumferential surface. Once the desired deployment location is reached, the sleeve 134 may then be removed and the springs (not shown) disposed within the respective spring-loaded chambers 138 allowed to expand to the neutral or ambient position. Accordingly, the piston members 140, along with the expansion heads 142 coupled thereto, displace radially outward as depicted in FIG. 16B. The radial expansion, in turn, leads to abutment of the expansion heads 142 against the inner diameter of the expandable tubular (not shown). As such, sufficient radial forces are provided to drive the tubular to its expanded configuration.

If each disc 132 acting individually does not provide sufficient radial force to expand a tubular, a plurality of discs 132 can be used to apply sufficient force. By employing a plurality of discs 132, each of the springs disposed within the spring-loaded chambers 138 may be springs of varying spring constants. As such, the radial forces applied to various sections of the expandable tubular may be varied to conform to differing wellbore environments.

Figure 17:
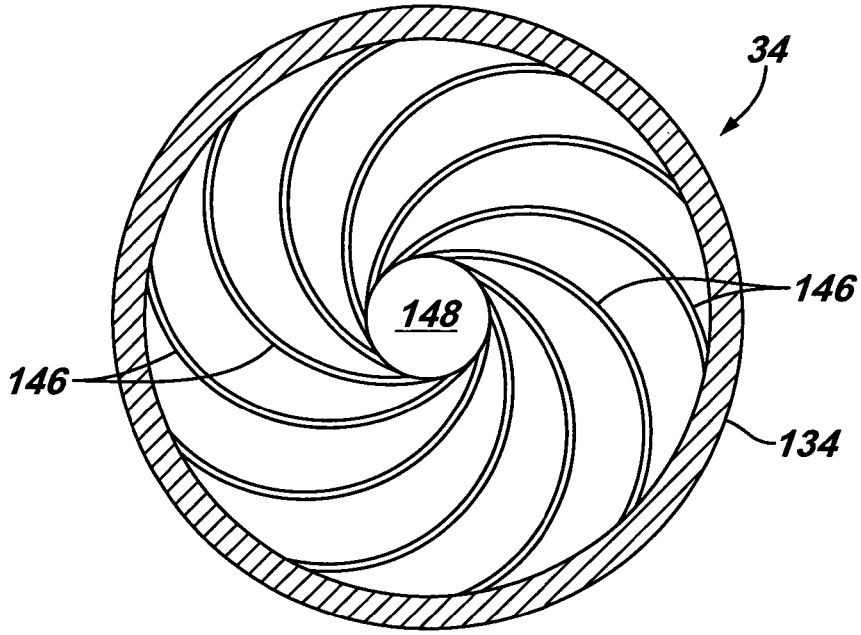
FIG. 17 illustrates an embodiment of an expansion tool comprising springs wrapped around a center tube.

Referring to FIG. 17, another arrangement of the present embodiment is illustrated. In this arrangement, loaded spring members 146 are wrapped around a center tube 148. The sleeve 134 is disposed circumferentially about the loaded springs 146 and maintains the tool 34 in a compressed configuration. Once the desired deployment location within the wellbore is reached, the sleeve 134 may be removed and the loaded springs 146 are allowed to naturally unwrap. The unwrapping imparts the radial forces necessary to expand the tubular from its collapsed stated to its expanded state.

Figure 18A:
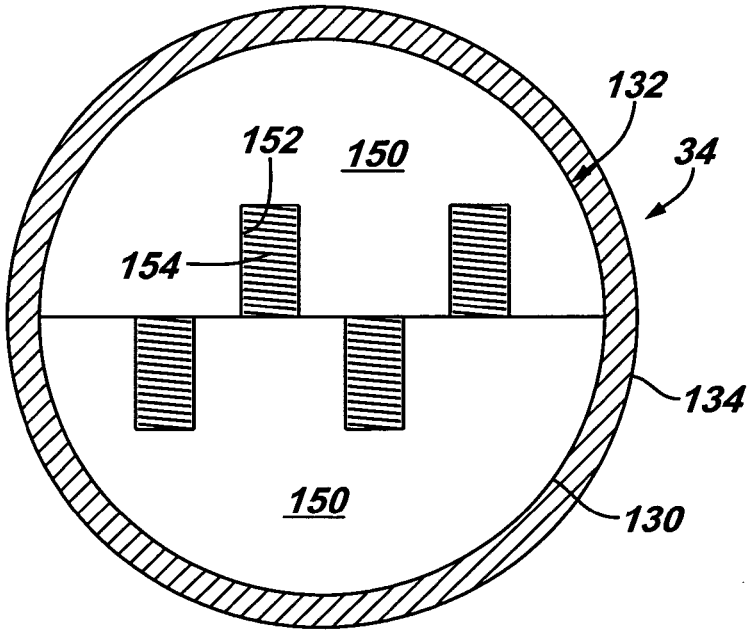
FIGS. 18A and 18B are partial cross-sectional views of an embodiment of an expansion tool comprising circular discs.
Figure 18B:
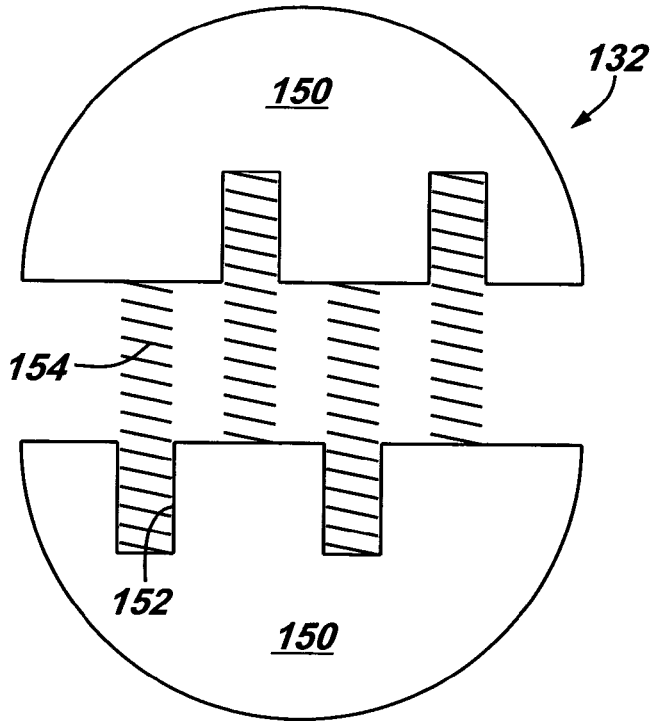

Referring to FIGS. 18A and 18B, another multi-disc arrangement of the present embodiment is illustrated. In this arrangement, each disc 132 comprises a plurality of disc sections 150. Each disc section 150 may have channels 152 configured to house compression springs 154 therein. In this arrangement, each disc 132 is depicted as having two separate disc halves, however, arrangements having a variety of disc sections 150 and shapes are envisaged.

As depicted in FIG. 18A, the sleeve 134 maintains the arrangement in a compressed configuration. Similar to the arrangements above, when the desired deployment location is reached, the sleeve 134 may be removed and the discs 132 allowed to transition to their expanded configuration as depicted in FIG. 18B. This expansion, in turn, imparts radial forces on the tubular and drives the tubular to its expanded state. Also, the discs 132 may be stacked at various orientations to achieve optimum force distributions. For example, the discs 132 may be stacked at orientations offset 90 degrees with respect to each other. As such, the stacked discs 132 may present an optimal or beneficial radial force distribution for a given wellbore environment.

Figure 19:
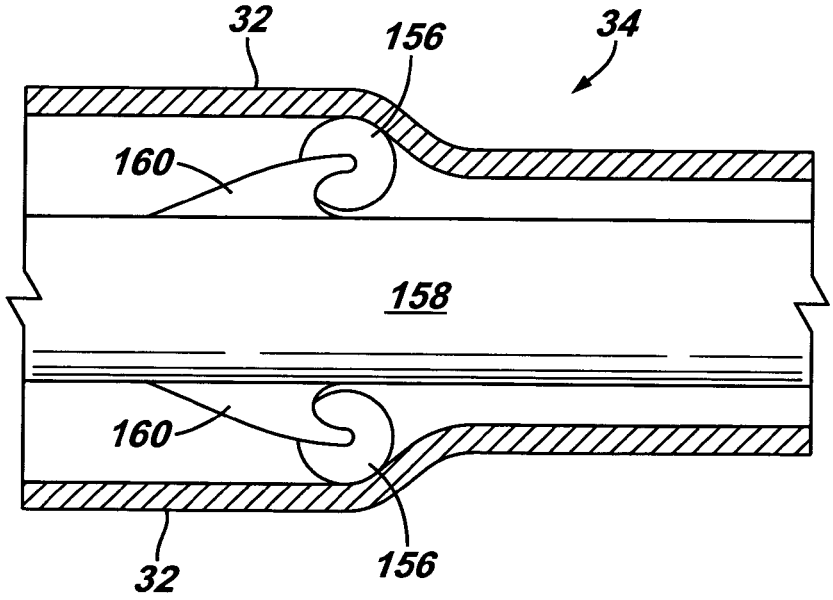
FIG. 19 illustrates an embodiment of an expansion tool having rollers biased into engagement with a tubular.

In another embodiment of the present technique, the tool 34 may comprise rolling or rotating members. An arrangement of this embodiment is illustrated in FIG. 19. In this arrangement, the deployment tool 34 comprises a pair of rollers 156 coupled to a body 158 of the deployment tool 34 via members 160, e.g. elastic members. As the tool 34 is deployed, members 160 impart forces that direct the rollers 156 radially outward, in turn, imparting radially outward forces on the inner diameter of the tubular 32. Furthermore, the rollers 156 reduce the amount of axial driving force necessary to push or pull the tool 34 in the direction of deployment. Simply put, the rollers dramatically reduce the resistive force of friction between the tool 34 and the tubular 32.

Additionally, the elastic members 160, if so desired, may be coupled to actuating tools (not shown) that act under mechanical or hydraulic forces. These actuating tools may be designed to provide additional radial forces to optimize expansion of the tubular 32 under varying wellbore environments. Moreover, the actuating devices may manipulate the overall diameter of the deployment tool 34 by altering the radial position of the rollers 150. This, in turn, facilitates easy removal of the deployment tool 34 from the wellbore 36.

Figure 20:
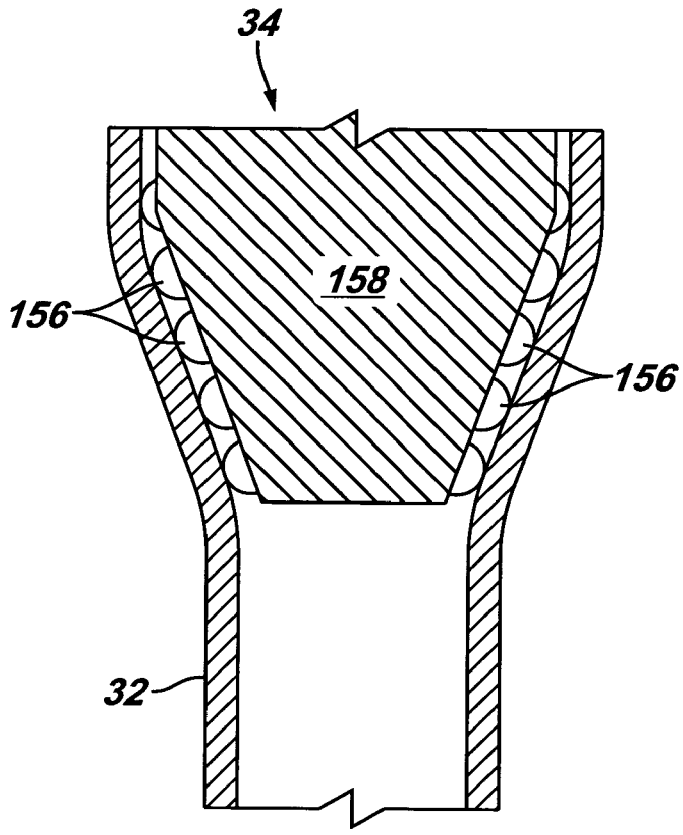
FIG. 20 illustrates an embodiment of an expansion tool having rollers disposed along a lateral surface.

An alternative arrangement of this embodiment is illustrated in FIG. 20. In this arrangement, the deployment tool 34 comprises a tapered body 158 having a plurality of rollers 156 disposed along the tapered surfaces. As can be seen, the smaller leading diameter of the body 158 facilitates insertion of the tool 34 into a collapsed tubular 32. Once the body 158 is inserted into the tubular 32, an axial driving force may then be applied to the tool 34. The rollers 156 reduce the resistive frictional forces between the deployment tool 54 and the expanding tubular 32. Accordingly, a lesser axial driving force is necessary to accomplish expansion of the tubular 32.

Figure 21:
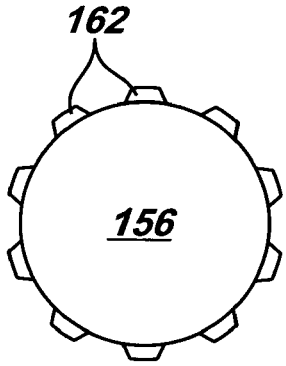
FIG. 21 is a cross-sectional view of a roller of the expansion tool illustrated in FIG. 20.
Figure 22:
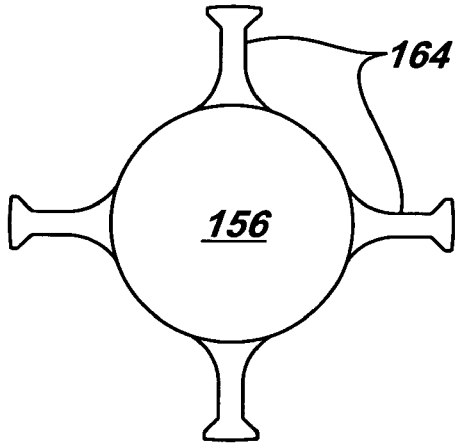
FIG. 22 is a cross-sectional view of another roller of the expansion tool illustrated in FIG. 20.

Focusing on FIGS. 21 and 22, the rollers 156 may comprise various surface features. For example, FIG. 21 illustrates a roller 156 having a plurality of raised members 162 disposed circumferentially thereabout. FIG. 22 also illustrates an exemplary surface feature wherein the roller 156 comprises a plurality of extension members 164 disposed circumferentially thereabout. The circumferential features 162 and 164 provide improved force distributions for expanding a tubular in certain wellbore environments.

Figure 23:
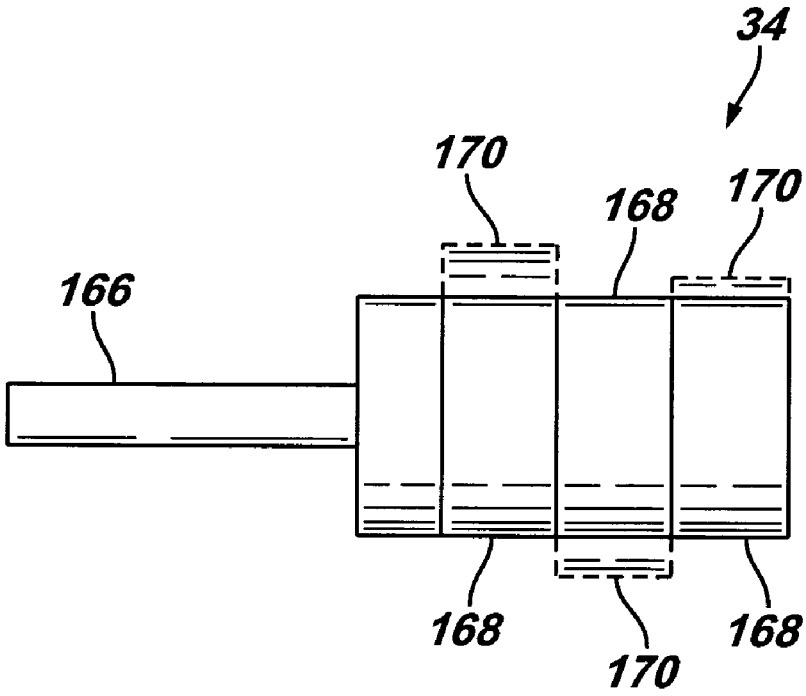
FIG. 23 illustrates an embodiment of an expansion tool comprising a plurality of coaxially aligned rollers having portions radially offset with respect to a central axle.

Another arrangement of this embodiment is illustrated in FIG. 23. In this arrangement, the deployment tool 34 comprises a central axle 166 having co-axial rollers 168 disposed thereabout. Each of the co-axial rollers 168 may have an offset portion 170, the offset portion 170, represented by dashed lines, provides the necessary radial forces. In other words, as the tool 34 is deployed, the offset portion 170 comes into contact with the inner diameter of the tubular and imparts the necessary radial forces to expand the tubular.

To facilitate the entry of tool 34 into the tubular, the offset portions 170 may be of increasing size with respect to one another. For example, the offset portion 170 of the leading roller 168 may be the smallest so as to allow easy entry of the tool 34 into the tubular. After roller 168 has expanded the tube, as determined by the size of the offset portion 170, the remaining larger rollers are moved into the tubular. The conical arrangement of the rollers may also provide alignment assistance to the deployment tool 34.

Figure 24:
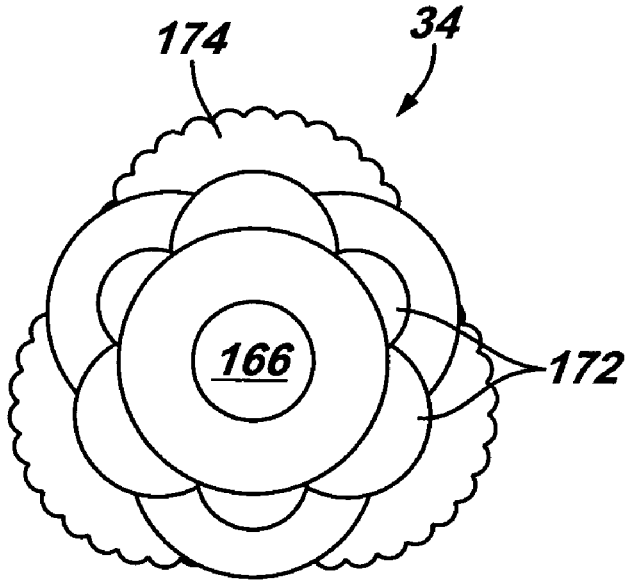
FIG. 24 illustrates an embodiment of an expansion tool comprising a plurality of fans aligned in an offset configuration about a central axle.

Yet another arrangement of this embodiment is illustrated in FIG. 24. In this arrangement, the tool 34 comprises a plurality of fans 172 disposed in an offset manner about a central axle 166. As the tool 34 is deployed, the rotating fans 172 abut against the inner diameter of the tubular and expanding the tubular. To facilitate deployment, the fans 172 may be sized to collectively correspond with the shape of an inverted cone. Such a shape facilitates gradual insertion of the tool 34 as well as gradual expansion of the tubular.

Moreover, the inverted conical shape may aid in alignment of the tool 34 within the tubular. Also of note, the fans 172 may comprise circumferentially disposed features 174. Advantageously, these features 174 may be configured to optimize the distribution of radial expansion forces on the tubular.

Figure 25:
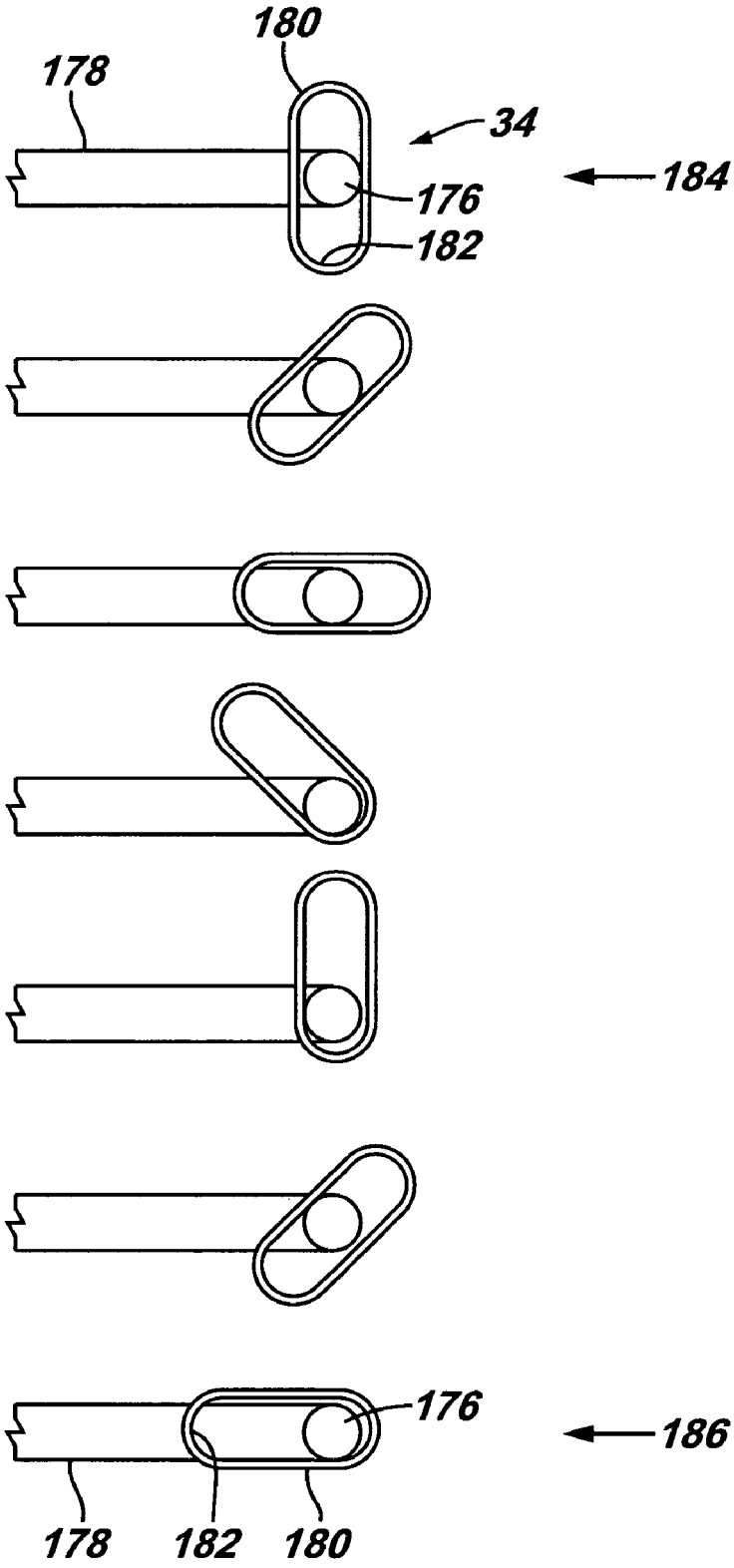
FIG. 25 depicts an embodiment of an expansion tool comprising a tank-track roller.

Referring to FIG. 25, this figure depicts an alternative arrangement and deployment sequence of the present embodiment. In this arrangement, a plurality of drive axles 176 are connected to corresponding braces 178. Disposed about each drive axle 176 may be an elliptical tank-track 180. In operation, the axle 176 drives against the inner perimeter 182 of the tank-track 180 causing the tank-track 180 to move in an elliptical manner about the axle 176. To achieve better engagement between the two elements, the inner surface or perimeter 182 of the tank-track 180 may comprise a plurality of teeth (not shown) that correspondingly engage with grooves (not shown) on the axle 176. During deployment through the tubular, axles 176 rotate the tank-tracks 180, and the elliptical shape of each tank-track 180 causes it to abut against the inner diameter of the tubular and provide from the necessary radial forces to expand the tubular.

The various stages of motion of this arrangement may begin with the first stage 184 showing the tank-track 180 disposed perpendicular to the shaft 178. As the tool 34 is deployed into the wellbore, the tank-track 180 moves about the axle 176 as depicted in each successive stage until the last stage 186 is reached.

Figure 26:
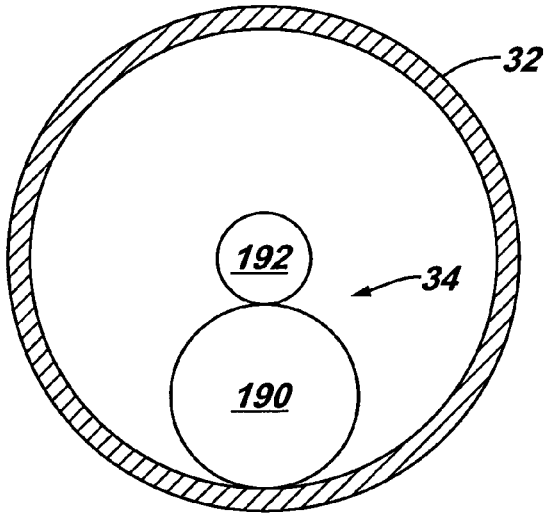
FIG. 26 is a partial cross-sectional view of an embodiment of an expansion tool comprising a planet gear which circumferentially rotates about a central gear shaft.

Referring to FIG. 26, an alternate embodiment of the present technique is illustrated. In this embodiment, the deployment tool 34 comprises a planet gear 190 disposed about a central gear shaft 192 running axially through tubular 32. The shaft 192 can be moved to an offset position, or the shaft 192 or gear 190 can be formed with an eccentric cross-section to provide radially directed expansion forces when rotated. Once positioned at the desired deployment location within the tubular 32, a drive mechanism (not shown) actuates the central gear shaft 192, causing the planet gear 190 to propagate in a circular direction. As the tubular 32 is expanded, the tool 34 may be progressively driven further into the wellbore, thereby progressively expanding the tubular 32.

Figure 27:
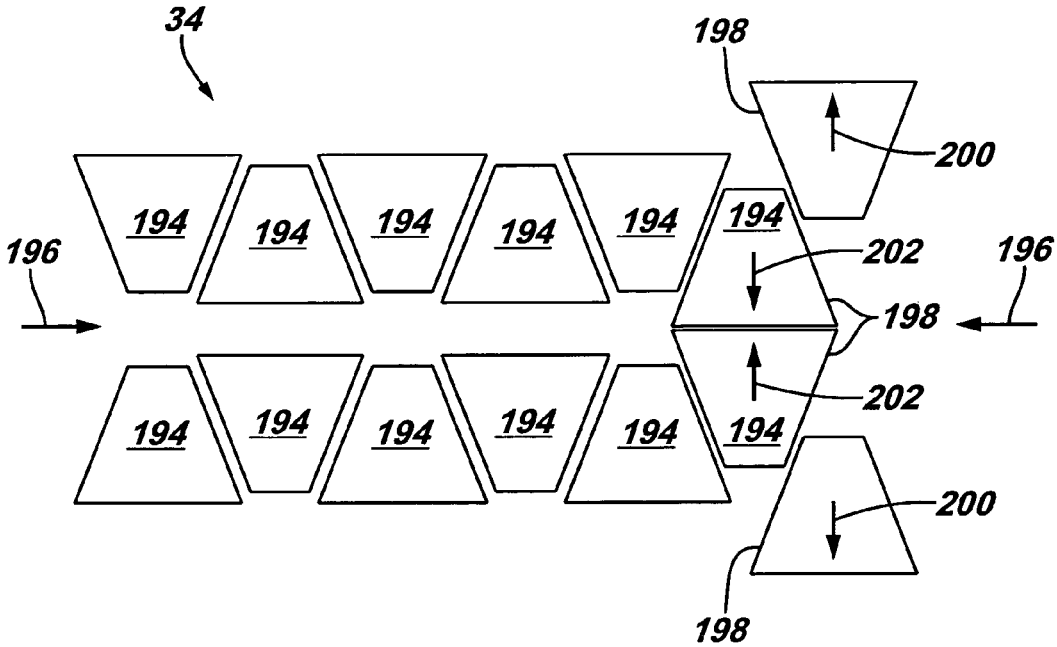
FIG. 27 illustrates an embodiment of an expansion tool comprising a plurality of block members that move in a radial direction in reaction to an axial force.

Referring to FIG. 27, another alternate embodiment of the present technique is illustrated. In this embodiment, the tool 34 comprises a plurality of block members 194 having sloped surfaces 198 arranged in longitudinally mirrored pairs. Laterally adjacent block members 194 may be oriented at 180 degree offsets with respect to one another. Subsequent to the deployment of the tool to the desired deployment location, an axial force 196 is applied to the axially outermost mirrored pairs. In this embodiment, the interaction between adjacent sloped surfaces 198 of adjacent block members 194 translates a portion of the axial force into an outward radial force 200. Although a portion of the axial force 196 is translated into a radially inward force 202, the abutment of the block members 194 against one another prevents inward radial displacement, and alternating mirrored pairs are driven radially outward. Accordingly, the block members 189 drive the tubular to an expanded configuration.

Figure 28:
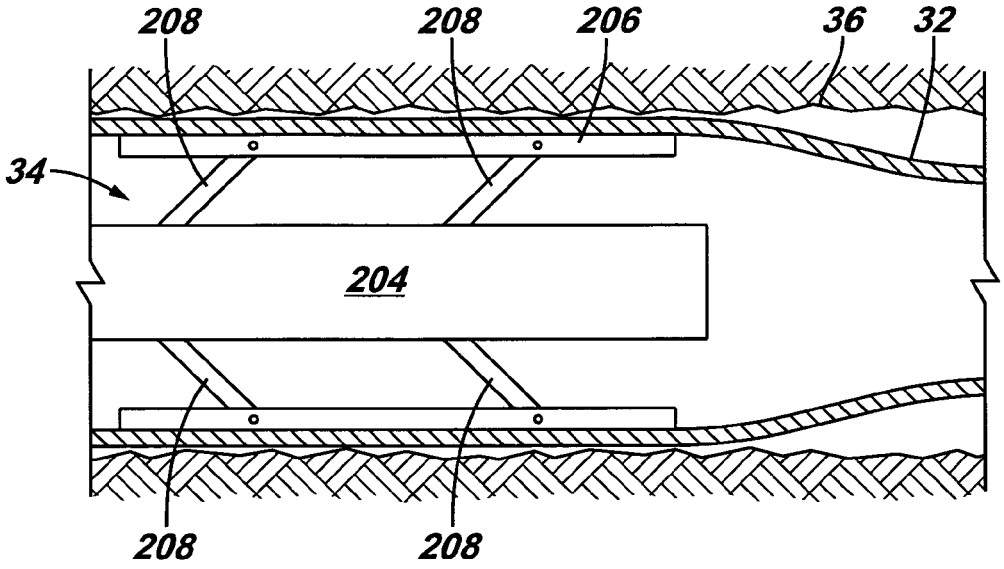
FIG. 28 illustrates an embodiment of an expansion tool comprising a plurality of expansion members hingedly connected to a body of the tool.

Referring to FIG. 28, an alternate embodiment of the present technique is illustrated. In this embodiment, the expansion tool 34 comprises a deployment body 204 having expansion members 206 coupled thereto via hinge members 208. Upon positioning of the tool at the desired deployment location within the wellbore 36, the hinge members 208 may be actuated by axial movement the body 204 to drive the expansion members 206 in the radially outward direction. This outward movement of expansion members 206 drives the tubular 32 to its expanded configuration. Subsequently, the expansion members 206 may be returned to a neutral state and redeployed to expand the tubular at the next desired location within the wellbore 36.

Figure 29:
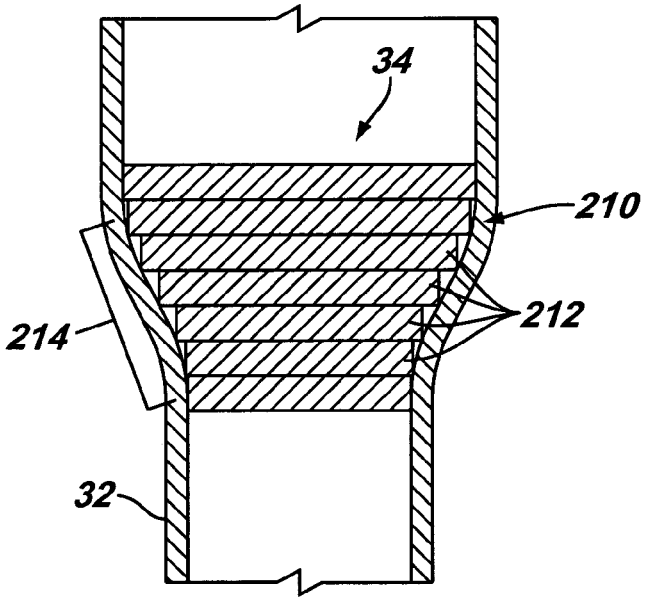
FIG. 29 illustrates an embodiment of an expansion tool comprising a tapered mandrel having a plurality of stepped portions.

Lastly, referring to FIG. 29, this figure illustrates another embodiment of the present technique. In this embodiment, the exemplary expansion tool 34 comprises a tapered mandrel 210. The tapered mandrel 210 comprises a plurality of stages 212 that progressively increase in diameter to give the tapered mandrel 210 a stepped profile 214. The progressive tapering or inverted conical shape facilitates insertion of the tapered mandrel 210 into a collapsed tubular 32. In operation, as an axial force is applied to the mandrel 210, abutment of the tool 34 against the interior diameter of the tubular 32 imparts the radial forces necessary to drive the tubular 32 into the expanded configuration.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system for expanding the diameter of a tubular disposed within a wellbore, comprising:

an expandable tubular having an interior surface, and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the selectively expandable portion comprises a plurality of pistons, wherein the pistons actuate under the influence of a biasing member, and wherein the pistons comprise subsystem members positioned to rotatably engage the biasing member.

2. A system for expanding the diameter of a tubular disposed within a wellbore, comprising:

an expandable tubular having an interior surface, and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the selectively expandable portion comprises a plurality of pistons, wherein the pistons actuate under the influence of a biasing member, and wherein the biasing member travels upwardly through the wellbore.

3. The system as recited in claim 2, further comprising a wireline adapted to engage the biasing member, the wireline being insertable into the wellbore under influence of a fluid.

4. The system as recited in claim 3, wherein the wireline comprises a plurality of flanges adapted to receive the fluid.

5. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion tool comprises an inflatable member disposed along a central mandrel.

6. The system as recited in claim 5, wherein the inflatable member comprises a plurality of inflatable members and inflates via a liquid.

7. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion tool comprises a compressible elastomer.

8. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion tool comprises a compressible spring, the spring being adapted to radially expand during transition from a compressed configuration to an expended configuration.

9. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, the expansion tool further comprising a roller, wherein the roller comprises elliptical members having an interior engagement surface; and further comprising an axle, wherein the interior engagement surface of the roller travels along a circumference of the axle.

10. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion portion comprises a plurality of expandable discs.

11. The system as recited in claim 10, further comprising a removable sleeve disposed about the expandable discs, wherein the sleeve retains the expandable discs in a compressed configuration.

12. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion tool comprises a first rotating member coupled to a second rotating member, wherein rotation of the first member about the second member provides the radial expansion force.

13. A system for expanding the diameter of a tubular disposed within a wellbore, comprising:

an expandable tubular having an interior surface; and an expansion tool configured to fit within a perimeter defined by the interior surface, the expansion tool having a selectively expandable portion, wherein the selectively expandable portion imparts a radial expansion force against the interior surface to drive the expandable tubular to an expanded state, wherein the expansion tool comprises a plurality of block members, wherein at least one of the plurality of block members is adapted to travel radially outward in response to an axial compressive force.

14. An expansion system to expand a tubular disposed in a wellbore, comprising:

an expansion mechanism sized for deployment within the interior of the tubular, the expansion mechanism comprising a radially expandable portion, the radially expandable portion being configured to enable selective expansion of the tubular to an expanded state by imparting a force directed radially against the tubular, wherein the expansion mechanism comprises an inflatable member disposed along a supporting mandrel.

15. An expansion system to expand a tubular disposed in a wellbore, comprising:

an expansion mechanism sized for deployment within the interior of the tubular, the expansion mechanism comprising a radially expandable portion, the radially expandable portion being configured to enable selective expansion of the tubular to an expanded state by imparting a force directed radially against the tubular, wherein the expansion mechanism comprises an expansion plate biased in a radially outward direction with respect to an axis of the wellbore.

16. An expansion device for expanding a tubular within a wellbore, comprising a mandrel having a stepped profile oriented to engage an interior surface of the tubular, the stepped profile being formed of adjacent stages, each stage having a smaller diameter than the preceding stage along the direction of movement of the mandrel during expansion.

17. The expansion device as recited in claim 16, wherein the stepped profile extends along a portion of the mandrel in an axial direction.

18. A method for expanding a tubular having contracted and expanded states, comprising:

disposing a tubular in a contracted state within a wellbore;

disposing an expansion tool at least partially within an interior region of the contracted tubular; and activating an expansion portion of the expansion tool such that the expansion portion imparts a radial force on the tubular sufficient to transition the tubular to a radially expanded configuration, wherein activating comprises inflating a plurality of tubes.

19. A method for expanding a tubular having contracted and expanded states, comprising:

disposing a tubular in a contracted state within a wellbore;

disposing an expansion tool at least partially within an interior region of the contracted tubular; and activating an expansion portion of the expansion tool such that the expansion portion imparts a radial force on the tubular sufficient to transition the tubular to a radially expanded configuration, wherein activating comprises rotating the expansion member.

20. A method for expanding a tubular having contracted and expanded states, comprising:

disposing a tubular in a contracted state within a wellbore;

disposing an expansion tool at least partially within an interior region of the contracted tubular; and activating an expansion portion of the expansion tool such that the expansion portion imparts a radial force on the tubular sufficient to transition the tubular to a radially expanded configuration, wherein activating comprises removing a sleeve positioned to restrict expansion of the expansion portion.

21. A method for expanding a tubular having contracted and expanded states, comprising:

disposing a tubular in a contracted state within a wellbore;

disposing an expansion tool at least partially within an interior region of the contracted tubular; and activating an expansion portion of the expansion tool such that the expansion portion imparts a radial force on the tubular sufficient to transition the tubular to a radially expanded configuration, wherein activating comprises compressing the expansion tool via an axial compressive force.

* * * * *